US011666130B2

(12) United States Patent
Louvaris

(10) Patent No.: US 11,666,130 B2
(45) Date of Patent: Jun. 6, 2023

(54) HAIR AND SCALP PROTECTION DEVICES AND METHODS

(71) Applicant: Easy Hair LLC, Minneapolis, MN (US)

(72) Inventor: Thomas Louvaris, Minneapolis, MN (US)

(73) Assignee: Easy Hair LLC, Minneapolis, MN (US)

( * ) Notice: Subject to any disclaimer, the term of this patent is extended or adjusted under 35 U.S.C. 154(b) by 706 days.

(21) Appl. No.: 16/511,915

(22) Filed: Jul. 15, 2019

(65) Prior Publication Data

US 2020/0015563 A1 Jan. 16, 2020

Related U.S. Application Data

(60) Provisional application No. 62/698,024, filed on Jul. 14, 2018.

(51) Int. Cl.

| | |
|---|---|
| ***A45D 8/24*** | (2006.01) |
| ***A45D 8/28*** | (2006.01) |
| ***A45D 8/30*** | (2006.01) |

(52) U.S. Cl.
CPC *A45D 8/28* (2013.01); *A45D 8/30* (2013.01)

(58) Field of Classification Search
CPC ... A45D 8/24; A45D 8/28; A45D 8/30; A45D 8/32; A45D 8/26; A45D 1/08; A45D 1/06;

(Continued)

(56) References Cited

U.S. PATENT DOCUMENTS 953,348 A * 3/1910 Prevear
1,116,852 A * 11/1914 Senegas ..... A45D 1/06 132/263

(Continued)

FOREIGN PATENT DOCUMENTS

CA 02280774 * 8/1998
EP 2145557 * 1/2010

(Continued)

OTHER PUBLICATIONS

"Beadalon AWA-NSI3405 Artistic Wire Nylon Jaw Pliers," Beadalon, Retrieved online from <https://www.amazon.com/Beadalon-AWA-NSI3405-Artistic-Nylon-Pliers/dp/B0018N61JM/ref=asc_df_B0018N61JM/?tag=hyprod-20&linkCode=df0&hvadid=198090893745&hvpos=1o1&hvnetw=g&hvrand=5032926674457632211&hvpone=&hvptwo=&hvqmt=&hvdev=c&hvdvcmdl=&hvlocint=&hvlocphy=9060341&hvtargid=pla-318588546893&psc=1> on Jul. 3, 2019, 5 pages, believed to be publicly available more than 1 year prior to the filing of this application.

(Continued)

*Primary Examiner* — Rachel R Steitz
*Assistant Examiner* — Brianne E Kalach
(74) *Attorney, Agent, or Firm* — Faegre Drinker Biddle & Reath LLP

(57) ABSTRACT

Disclosed herein are devices and methods for holding hair to prevent hair damage during combing procedures. A hair gripping device can include a handle, a jaw connected to the handle, and a grip retained within the jaw. The handle and the jaw may comprise portions of first and second arms of the hair gripping device. The grip may be configured to hold a plurality of hair strands at a hair contact portion of the grip. With actuation of the handle, the jaw may be configured to move between a closed position in which movement of a majority of strands in a bundle of hair within the first hair (Continued)

contact portion is inhibited by the grip and an open position in which movement of a majority of hair strands in a bundle of hair within the first hair contact portion is not inhibited by the grip.

20 Claims, 17 Drawing Sheets

(58) Field of Classification Search
CPC ..... A45D 1/14; A45D 2/001; A45D 2/002; A45D 2/40; A45D 2/42; A45D 19/02
See application file for complete search history.

(56) References Cited

U.S. PATENT DOCUMENTS 1,618,306 A * 2/1927 Pedersen ..... A45D 1/06 132/263
2,166,460 A * 7/1939 Burns ..... A45D 8/20 132/277
2,715,907 A * 8/1955 Boynton ..... A45D 1/06 132/242
2,818,871 A * 1/1958 Beaudry ..... A45D 8/34 132/278
3,419,017 A * 12/1968 Solomon ..... A45D 2/001 132/223
5,758,672 A * 6/1998 Chou ..... A45D 8/20 132/277
5,918,607 A 7/1999 Zucker
6,119,702 A * 9/2000 Habibi ..... A45D 1/04 132/118
6,138,376 A * 10/2000 Garfinkel ..... A45D 2/001 34/283
6,223,753 B1 * 5/2001 Lo ..... A45D 2/001 132/224
7,917,983 B2 4/2011 Taggart et al.
8,967,159 B1 3/2015 Jenkins
9,072,356 B2 * 7/2015 Carey ..... A45D 8/20
9,402,460 B2 8/2016 Hickey
9,894,984 B2 2/2018 Accetura, Jr.
2002/0026206 A1 * 2/2002 Takehana ..... A45D 2/00 606/174
2005/0076930 A1 * 4/2005 Yuen ..... A46B 15/0024 132/132
2011/0120487 A1 * 5/2011 Rollat-Corvol ..... A61K 8/9789 132/200
2017/0188681 A1 * 7/2017 Leung ..... H05B 3/283

FOREIGN PATENT DOCUMENTS

FR 761297 * 9/1933
FR 737275 * 9/1935

OTHER PUBLICATIONS

"Booms Fishing G16 Fish Grip Clamp Fish Body Holder," Booms Fishing, Retrieved online from <https://www.amazon.com/Booms-Fishing-Fish-Clamp-Holder/dp/B07CGBNJ8X/ref=sr_1_2_sspa?keywords=fish+clamp&qid=1562161154&s=gateway&sr=8-2-spons&psc=1> on Jul. 3, 2019, 5 pages, believed to be publicly available more than 1 year prior to the filing of this application.

* cited by examiner

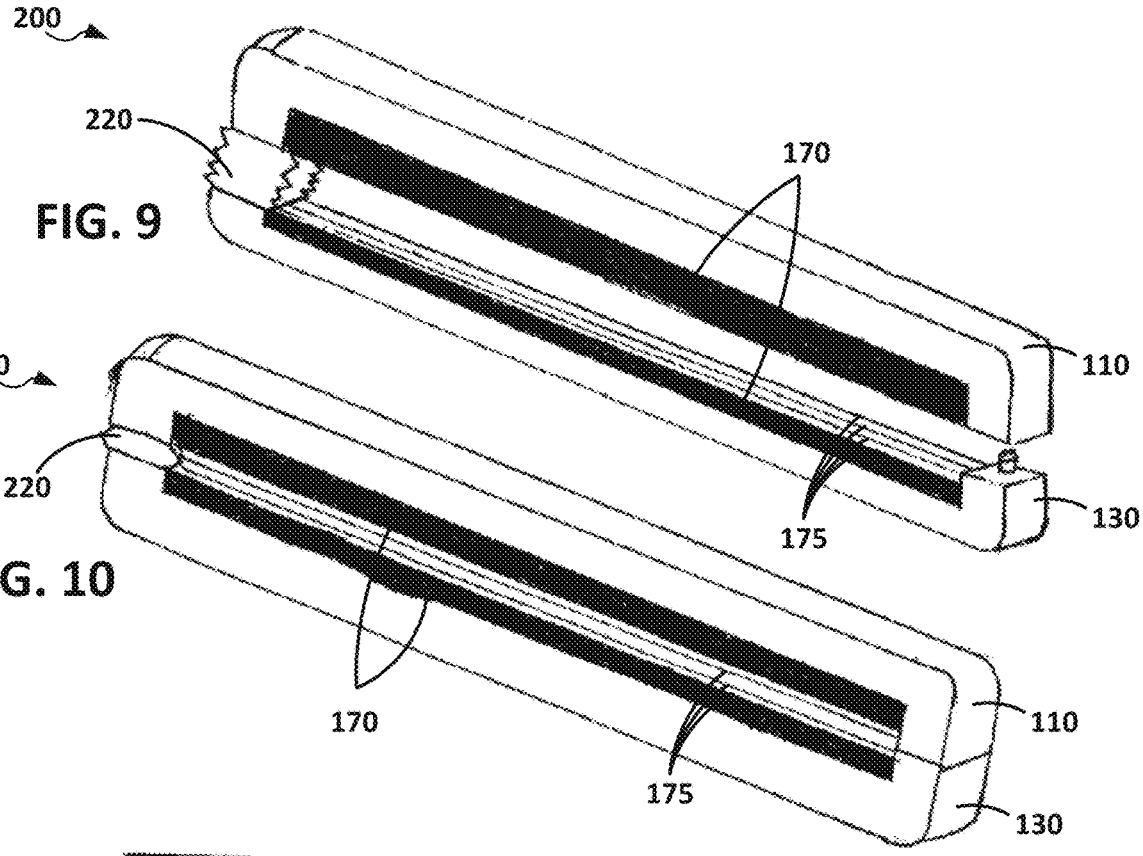
FIG. 9
FIG. 10
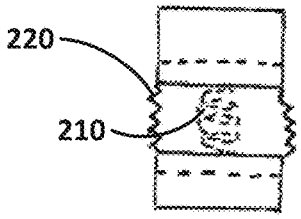
FIG. 11
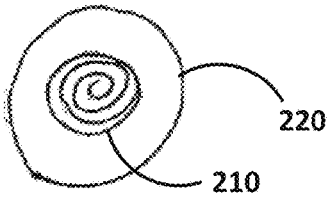
FIG. 12
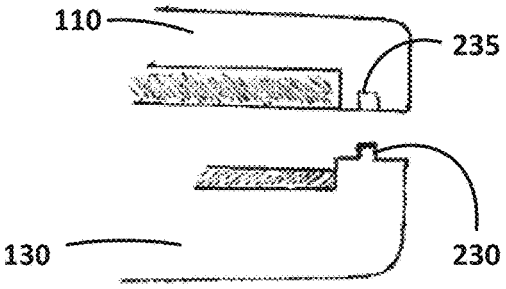
FIG. 13
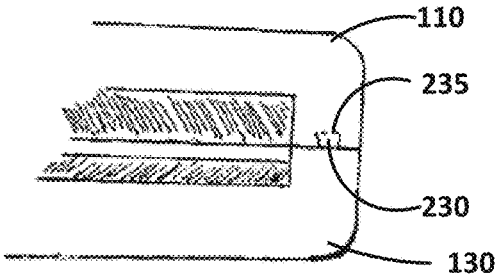
FIG. 14

HAIR AND SCALP PROTECTION DEVICES AND METHODS

CROSS-REFERENCE TO RELATED APPLICATION

This application claims the benefit of U.S. Provisional Patent Application No. 62/698,024, filed Jul. 14, 2018, which is incorporated by reference herein in its entirety.

TECHNICAL FIELD

The present disclosure generally relates to the field of hair grooming devices and, more specifically, to handheld hair grooming devices for holding hair during a combing procedure.

BACKGROUND

Unintentionally uprooting hair from the scalp is a problem experienced by many individuals combing or detangling long hair. Often, individuals find it difficult to detangle hair knots without uprooting the tangled hair or breaking the hair shafts. Uprooting hair from the scalp, along with breakage, are dangers that persist while engaging in combing or detangling wet or dry hair, even if the individual extensively lathered their hair with conditioner.

The uprooting of hair can be the unintentional and often unknown result of combing or detangling hair. One common cause for this uprooting can be individuals improperly holding their hair while combing or detangling. There can be additional causes, such as: (1) weak hair roots that cannot withstand the force of the comb or the user's fingers tugging on the hair, (2) forgetting to pay attention to how hard the individual is combing/pulling their hair, (3) having curly hair where the curls naturally coil up and are likely to develop hair knots, and (4) attempting to comb or detangle one's hair with heavy hair products or while the hair is dry.

The typical method of detangling or combing an individual's hair involves sectioning the individual's hair and then brushing the hair, starting with the ends and moving upward toward the roots with one's fingers or with a comb/brush. This task requires holding each section of hair in a fist, similar to holding a bouquet of flowers. The user may want to loosen any hair knots when the hair has been lathered with conditioner or similar product. Holding the hair in this way provides some grip to protect the hair strands from being uprooted or broken due to the force of the tool/method used (e.g., comb, fingers, etc.). However, it may be difficult to hold the section of hair sufficiently tight because of the need to multitask while detangling or combing. For example, to properly detangle and comb hair, the user may: (1) hold the section of hair tightly, (2) avoid pulling the hair section too hard, (3) maintain a high moisture level in the hair with conditioner if detangling, and (4) methodically comb/brush the hair.

The need to multitask often leads to high stress, subpar combing results, and potentially higher levels of hair loss because the user does not hold the designated hair section in a manner which prevents unwanted damage at the root. For example, by not holding the designated hair section tightly, at least some of the hairs are not in contact with a firm, grippy surface of the hand, glove, etc. Those hairs may be at risk of being pulled out prematurely because of the lack of grip.

Often, given the above risks, combing and detangling can be a painful experience for the individual, both physically and emotionally. Physically, hairs that survive the combing or detangling process may have split ends, indicating unhealthy or stressed hair, or have damaged hair shafts. Strands of hair combed and detangled under traditional methods may experience premature uprooting by pulling hair strands from the scalp before they reach the telogen phase, which is when the hair fully ages and falls from the scalp organically. Thus, to address the above risks and ensure a less painful experience, a need exists for devices and methods that conveniently allow a user to comb or detangle their hair while minimizing the risk of damaging the hair.

SUMMARY

The devices and methods disclosed in this application may minimize the risk of uprooting hair prematurely from the scalp or breaking hair while combing or detangling. By holding to-be-combed hairs in place, the device and methods generally may ease the overall process of combing or detangling hair by reducing the physical stress on the hair shafts and roots during a combing or detangling procedure.

Traditional devices used to straighten hair usually do not minimize the risk of hair loss during combing or detangling. Instead, traditional devices used to straighten hair are usually styling irons that have a comb-like feature or bristles. These styling irons may simultaneously detangle hair while the hair is being straightened. Unlike the present disclosure, such devices only seek to facilitate the process of combing/brushing hair, not actually preventing hair from receiving unnecessary and/or unwanted damage due to overstressing the root and/or the shaft of the hair. Traditional brushes or combs have been developed with a large variation in bristle size and orientation. Also, traditional brushes or combs vary with regards to the design of the brush skeleton. Some brushes or combs have experimented with the use of rotors for the purposes of combing or detangling. Although these devices may reduce the amount of hair loss when combing, they do not fulfill the purposes of the device disclosed in this application.

The disclosed devices may not be a brush or comb at all, but may be a device that holds hair in place, e.g., aiming to reliably replace the user gripping hair with their hands thereby improving hair retention while combing or brushing. The disclosed devices may grip a designated hair section across a grip surface rather than being held in a fist. Using the disclosed devices may reduce the problem regarding lack of hair exposure to a grippy surface when combing or brushing. A grip surface may contain two layers of rubber or a rubber-like surface that may prevent the hair from slipping out of the device even when the grip surface may be exposed to water or hair product.

To maximize the preventative benefits of this device, the user may begin combing or detangling with the device attached at the end of the hair shaft and slowly proceed toward the scalp once the lower sections of hair become detangled. Using the device may, over time, help the user's damaged hair return to its natural, healthy state. Such devices may allow the user to focus more on combing or detangling their hair, rather than contemplating how to hold a designated section of hair. This reduction in combing or detangling tasks may reduce anxiety and stress levels that are often associated with the tedious process of combing or detangling long hair.

BRIEF DESCRIPTION OF THE DRAWINGS

The following drawings are illustrative of particular embodiments of the present invention and therefore do not limit the scope of the invention. The drawings are intended for use in conjunction with the explanations in the following description. Embodiments of the invention may hereinafter be described in conjunction with the appended drawings, wherein like numerals denote like elements.

FIG. 5 is a rear elevational view of the first embodiment, showing a location of a grip surface that to-be-held hair may be placed on.

FIG. 9 is a perspective view of the second embodiment in an open position with a tab, a tab aperture, and an axial biasing member.

FIG. 10 is a perspective view of the second embodiment in a closed position with the tab, the tab aperture, and the axial biasing member.

FIG. 11 is a rear elevational view of the second embodiment, showing the axial biasing member, which may facilitate moving the second embodiment between the closed position and the open position.

FIG. 12 is a top elevational view of the axial biasing member and an associated cover.

FIG. 13 is a partial right elevational view of the second embodiment in the open position, showing the tab and the aperture.

FIG. 14 is a partial right elevational view of the second embodiment in the closed position, showing the tab received in the aperture.

DETAILED DESCRIPTION

The following detailed description is exemplary in nature and is not intended to limit the scope, applicability, or configuration of the invention in any way. Rather, the following description provides some practical illustrations for implementing examples of the present invention. Examples of constructions, materials, dimensions, and manufacturing processes are provided for selected elements, and all other elements employ that which is known to those of ordinary skill in the field of the invention. Those skilled in the art will recognize that many of the noted examples have a variety of suitable alternatives and any combination (e.g., all) of the features described with respect to one embodiment can be used in another. The scope of the present invention will in no way be limited to the number of constituting components, the materials, the shapes, the relative arrangement etc., and are disclosed simply as an example of embodiments of the present invention.

All four of the devices disclosed in this application may serve the same purpose. Their method of assembly and operation will be explained below.

Description of a First Embodiment

Figure 1:
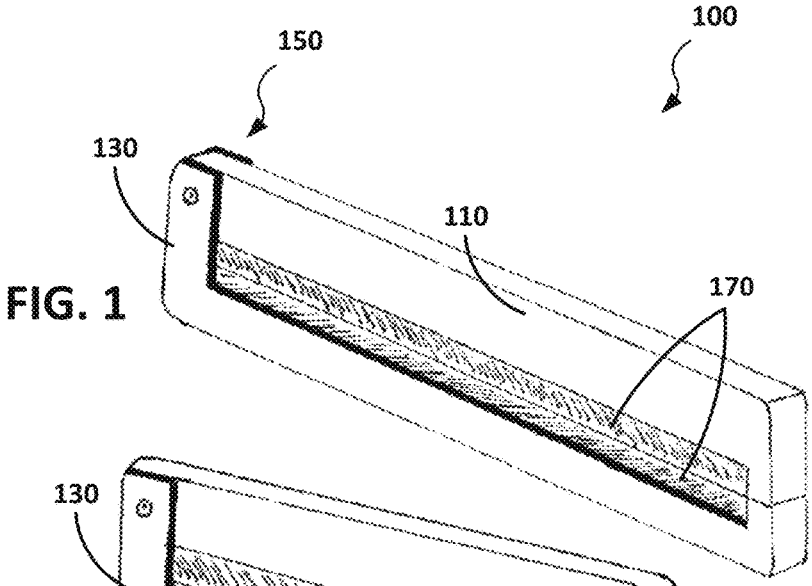
FIG. 1 is a perspective view of a first embodiment in a closed position.
Figure 2:
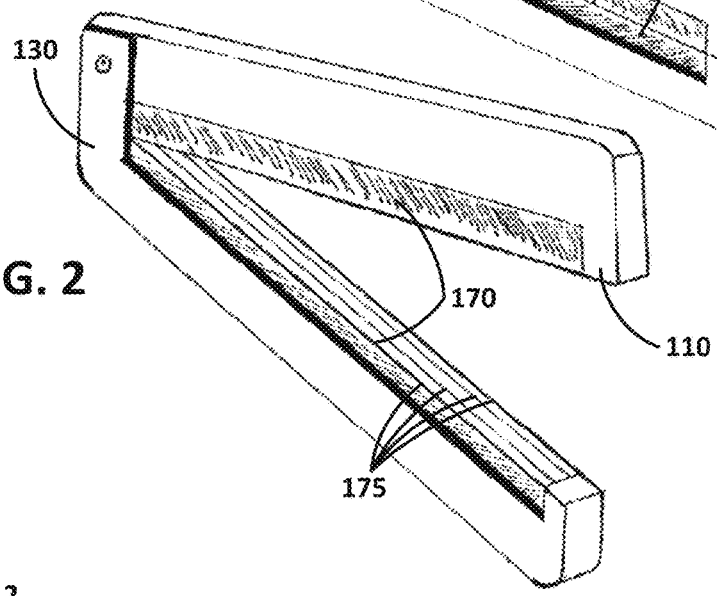
FIG. 2 is a perspective view of the first embodiment in an open position.

Please refer to FIGS. 1 and 2 depicting the first embodiment 100 in a perspective view. These figures show two major components of the first embodiment 100: a top arm 110 and a base arm 130. Both the top arm 110 and the base arm 130 of the first embodiment 100 may be manufactured using a sturdy material (e.g., plastics), which may be able to withstand a combing force without bending excessively. At the rear side of the first embodiment 100, the base arm 130 may serve as the base onto which the top arm 110 may be attached and may engage in a dedicated range of motion at a rotating area 150: opening the first embodiment 100 by rotating the top arm 110 upward and closing the first embodiment 100 by rotating the top arm 110 downward. In some embodiments, the base arm 130 may be designed to be wider than the top arm 110 to provide sufficient stability in the rotating area 150 of the first embodiment 100 to protect the rotating area 150 from damage, for example, due to physical stress.

Figure 3:
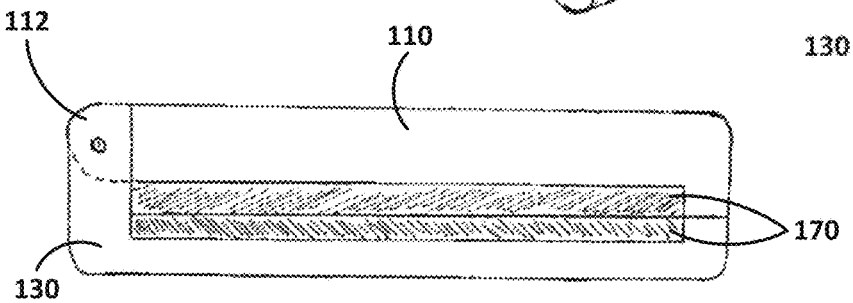
FIG. 3 is a right elevational view of the first embodiment in a closed position.

FIG. 3 depicts the right profile of the first embodiment 100. The top arm 110 and the base arm 130 are visible from this perspective. A rotation end 112 of the top arm 110 at the location where it is attached to the base arm 130 is also visible. Hidden lines demonstrate the rotational end 112 of the top arm 110. In many embodiments, the rotational end 112 can be rounded with respect to the direction of rotation so as to allow for rotational movement of the top arm 110 relative to the base arm 130. The top arm 110 may be able to rotate up to around 180 degrees while attached to the base arm 130 at the rotation end 112. In some embodiments, the top arm 110 may be able to rotate less or more than 180 degrees.

Figure 4:
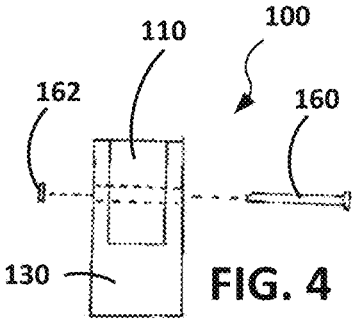
FIG. 4 is a rear elevational view of the first embodiment, showing where a pin may connect a top arm and a base arm of the first embodiment.

FIG. 4 depicts how the top arm 110 and the base arm 130 of the first embodiment 100 may be assembled. A pin 160 (comprising, e.g., a rust resistant metal such as stainless steel or from a durable plastic) may be used to secure both arms 110, 130 of the first embodiment 100 together. A rust resistant material may maximize the longevity of the first embodiment 100 and reduce friction, which could be caused by the build-up of rust from frequent exposure to moisture. The pin 160 can be retained in the first embodiment 100 by a lock 162.

Figure 5:
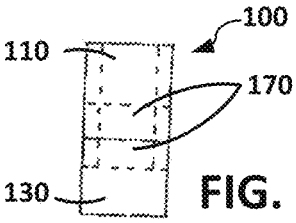
Figure 21A:
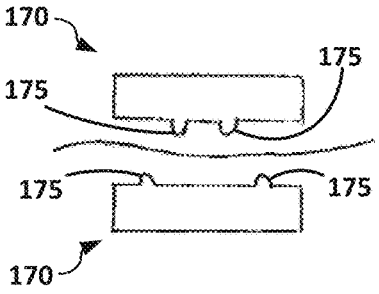
FIG. 21A is a cross sectional side elevational view of two grip surfaces of the third embodiment in the open position and hair placed within the grip surfaces.
Figure 21B:
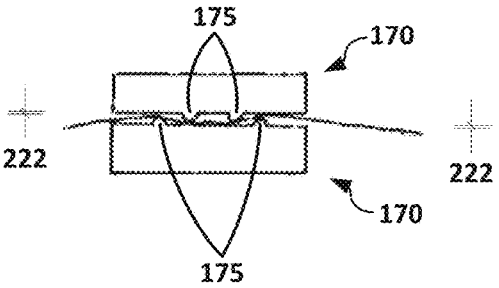
FIG. 21B is a cross sectional side elevational view of two grip surfaces of the third embodiment in the closed position and hair placed within the grip surfaces.

The shaded areas in FIGS. 1, 2, and 3 depict another major component of the first embodiment 100: a grip surface 170, which may secure the hair in place. In some instances, the first embodiment 100 may have more than one grip surface 170. The location of the grip surface 170 is also depicted with hidden lines from the rear view of the first embodiment 100 in FIG. 5. Each arm 110, 130 may have a dedicated indented area where the grip surface 170 may be attached. When the first embodiment 100 is closed, the grip surface 170 may come into contact with another component of the first embodiment 100 (e.g., another grip surface 170, the top arm 110, the base arm 130, etc.) and consequently secure the hair in place (as presented in FIGS. 21A and 21B).

Ridges 175 of the grip surface 170, as depicted in FIGS. 2, 17, 18, and 21, may contact each other in such a manner so as to hold a bundle of hair, thus maximizing a holding strength of the first embodiment 100. The design of the grip surface 170 apart from the dimensions may be the same for all embodiments and thus FIGS. 17, 18, 21A, and 21B may depict the design of the grip surface 170 for the first, second, and third embodiment. Ridges 175 of the grip surface 170 may be shaped to mate with other components of the first embodiment 100. For example, the ridges 175 of the top arm 110 may fall in between the ridges 175 of the base arm 130. The ridges 175 may press onto the base arm 130 of the hair raised by the ridges 175 of the base arm 130 (as best seen in FIGS. 21A and 21B) and thus make it harder for the hair to slip out of the first embodiment 100. Although discussed and depicted as having more than one ridge 175, one skilled in the art will appreciate that the first embodiment 100 can include a single ridge 175 and that some embodiments may not include any ridges 175.

Figure 6:
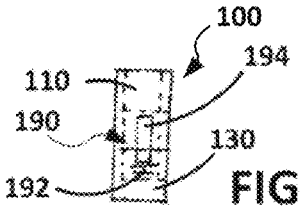
FIG. 6 is a front elevational view of the first embodiment, showing an adjustable lock with ribs and a clip.
Figure 7:
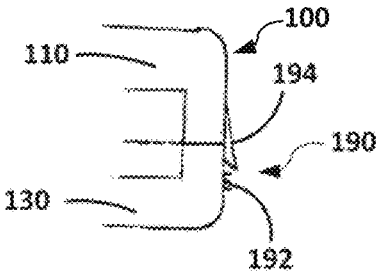
FIG. 7 is a partial right elevational view of the first embodiment, showing the adjustable lock with ribs and the clip.
Figure 8:
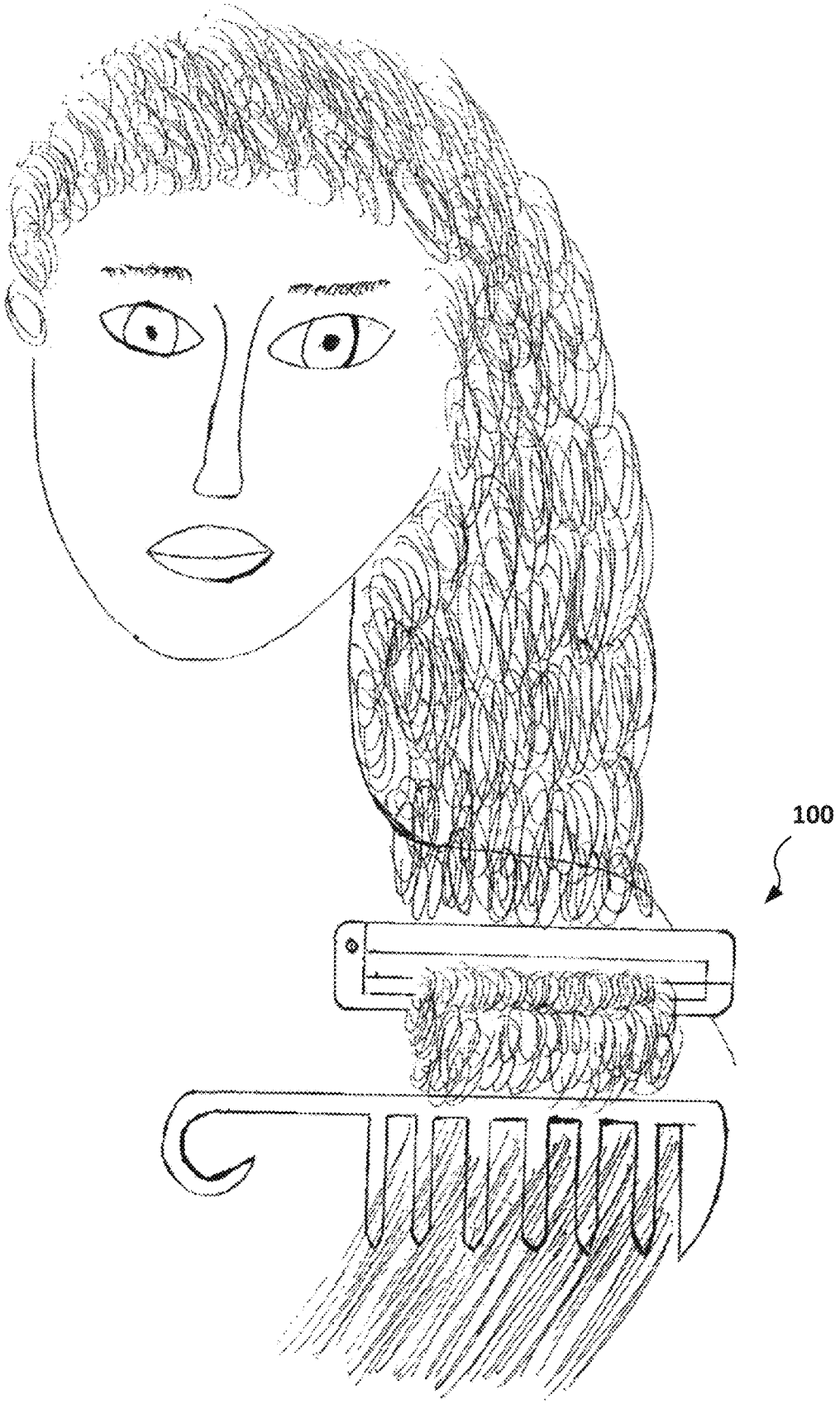
FIG. 8 is a perspective view of the first embodiment with a hair section that has been laid horizontally on the first embodiment and a user detangling their hair with a wide-tooth comb.
Figure 15:
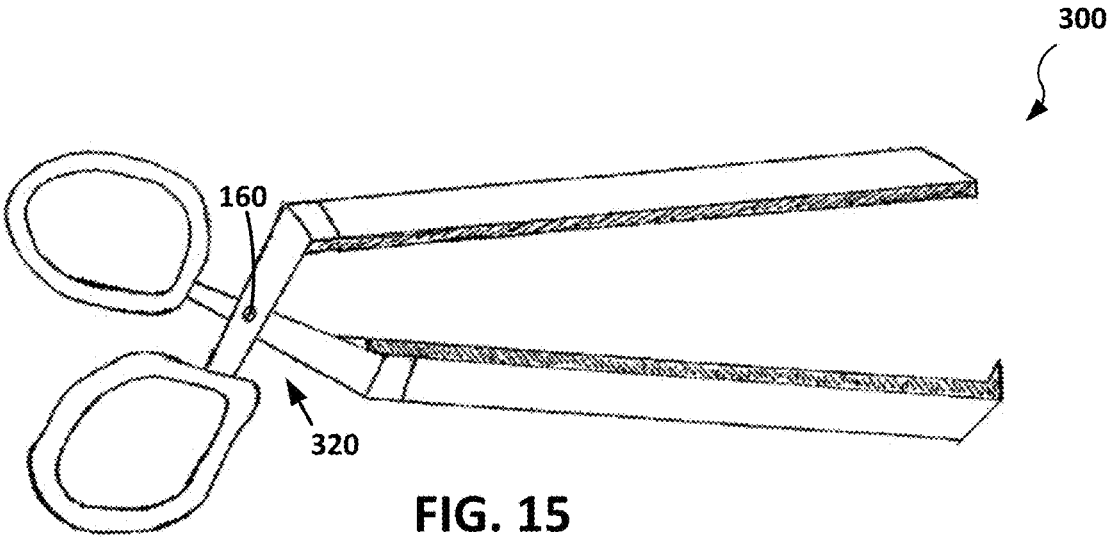
FIG. 15 is a right elevational view of the third embodiment, which includes a jaw with wide arms, in an open position.

The first embodiment 100 may include an adjustable lock 190, as observed in FIGS. 6 and 7, which may keep the first embodiment 100 closed without having the user constantly hold the first embodiment 100 tightly shut with their hand. The base arm 130 may have one or more ribs 192 protruding from a front surface of the base arm 130 while the top arm 110 may have a clip 194 protruding from the top arm 110 and extending downward where it may engage at least one of the ridges 175 of the base arm 130. The one or more ribs 192 and clip 194 together may serve as the adjustable lock 190 for the first embodiment 100. Between each ridge 175, the number of hair locks to fall between each rib 192 may depend on the thickness of the individual's hair. The ribs 192 and the clip 194 may be manufactured by the same material as the base arm 130 and the top arm 110 and may be an integral part of or separately attachable to the appropriate arm.

A method of operating the first embodiment 100 has been described throughout this section, yet it may be described in sequence for clarity. The first embodiment 100 may be a handheld object. The user may open the first embodiment 100 by rotating the top arm 110 upward, away from the base arm 130. The user may take one section of their hair and lay it onto the base arm 130 of the first embodiment 100 while spreading the hair horizontally to ensure the maximum number of hair strands are exposed to the grip surface 170. To close the first embodiment 100, the user may, for example, rotate the top arm 110 downward, toward the base arm 130 until the clip 194 engages the ribs 192 so as to secure the adjustable lock 190. Once the hair is held in place and the first embodiment 100 is closed, the user may be able to begin combing or detangling their hair, starting from the ends of the hair and proceeding toward the roots.

Description of a Second Embodiment

Referring to FIGS. 9 and 10, the second embodiment 200 will be described. As with the first embodiment, the second embodiment 200 shown in FIGS. 9 and 10 may minimize damage to an individual's hair by holding the hair during a combing procedure. The second embodiment 200 may be similar to the first embodiment. For example, two major components of the second embodiment 200 may be two arms: the top arm 110 and the base arm 130. Both arms 110, 130 of this embodiment may be manufactured with the same material of the first embodiment with the purpose to prevent the second embodiment 200 from bending excessively as a result of the force of the comb or any other object a user chooses to use to detangle or comb their hair. Note the rounded corners, of the second embodiment 200, which may, like the first embodiment, facilitate holding the second embodiment 200 to create a safer product as compared to a tool with sharp edges that may cause discomfort.

One of the differences of the second embodiment 200 may be that both arms 110, 130 may be of equal width. The second embodiment 200 may not have the rotational end of the first embodiment to open and close the second embodiment 200. Instead, the second embodiment 200 may use an axial biasing member 210 (e.g., a spring, a bushing, a telescopic cylinder, etc.) to be opened and closed along with a cover 220 as observed in FIG. 11 and FIG. 12. In some embodiments, the axial biasing member 210 may comprise metal or another rigid material, and the cover 220 may comprise elastomer or another semi-rigid material. The cover 220 may protect the axial biasing member 210 from corrosion due to exposure to moisture and may be sufficiently elastic to accommodate movements of the axial biasing member 210, allowing the second embodiment 200 to be opened in a variety of ways. For example, the user may be able to open the second embodiment 200 by twisting both arms 110, 130 to some degree, depending on the flexibility of the axial biasing member 210, and rotating the top arm 110 upward.

Further, similar to the first embodiment, the second embodiment 200 may contain the grip surface 170. The grip surface 170 and the ridges 175 of the grip surface 170 may be observed in FIGS. 9 and 10, as well as, in FIGS. 17, 18, 21A and 21B. In many embodiments, the grip surface 170 in this embodiment may not be in mating contact once the second embodiment 200 is closed. A gap 222 (best seen in FIG. 21B) between ridges 175 (e.g., approximately 0.2 mm-0.3 mm in height) may be allowed to accommodate thicker hair so that the second embodiment 200 may fully close around the hair. The dimensions of the gap 222 between ridges 175 may not be limited to the above and may be adjusted or eliminated in some instances. Similar to the gap 222, spacing between ridges 175 may also be adjusted, e.g., to accommodate thicker hair.

As seen in FIGS. 13-14, the second embodiment 200 may include a tab 230 at the front of the base arm 130 where the base arm 130 and the top arm 110 may meet once the second embodiment 200 is closed. The tab 230 may secure the second embodiment 200 in place and minimize any unwanted movements of both arms 110, 130 of the second embodiment 200 by being received within a tab aperture 235 when the second embodiment 200 is closed. The tab 230 may be sufficiently wide to avoid breaking and fatigue and may be sufficiently tall to secure both arms 110, 130 in place once the second embodiment 200 is closed. The tab 230 may not be a piece that is attached separately to the base arm 130 but rather may be part of the form, with an option to mold to the base arm 130, or in some instances, the top arm 110. For example, the tab 230 may be designed by trimming the specific area during the manufacturing of the base arm 130. In some embodiments, the tab 230 may be separately attachable to either arm 110, 130.

A method of operating the second embodiment 200 may be similar to that of the first embodiment. The second embodiment 200 may be a handheld object. For example, the user may take one section of their hair and lay it onto the base arm 130 of the second embodiment 200 while spreading the hair horizontally to ensure a maximum number of hairs is exposed to the grip surface 170. Once the hair has been laid out, the user may then close the second embodiment 200 by twisting, rotating, bending, or whichever motion may be used to close it. To close the second embodiment 200, the user may connect both arms 110, 130 so the tab 230 of the base arm 130 may be inserted in the aperture of the top arm 110. The axial biasing member 210 may allow the user to apply pressure by firmly gripping both arms 110, 130 to hold the hair in place and the axial biasing member 210 may, in turn, compress. Once the hair is locked into place, the user may begin combing or detangling their hair, starting from the ends of the hair and proceeding toward the roots.

Description of a Third Embodiment

Figure 20:
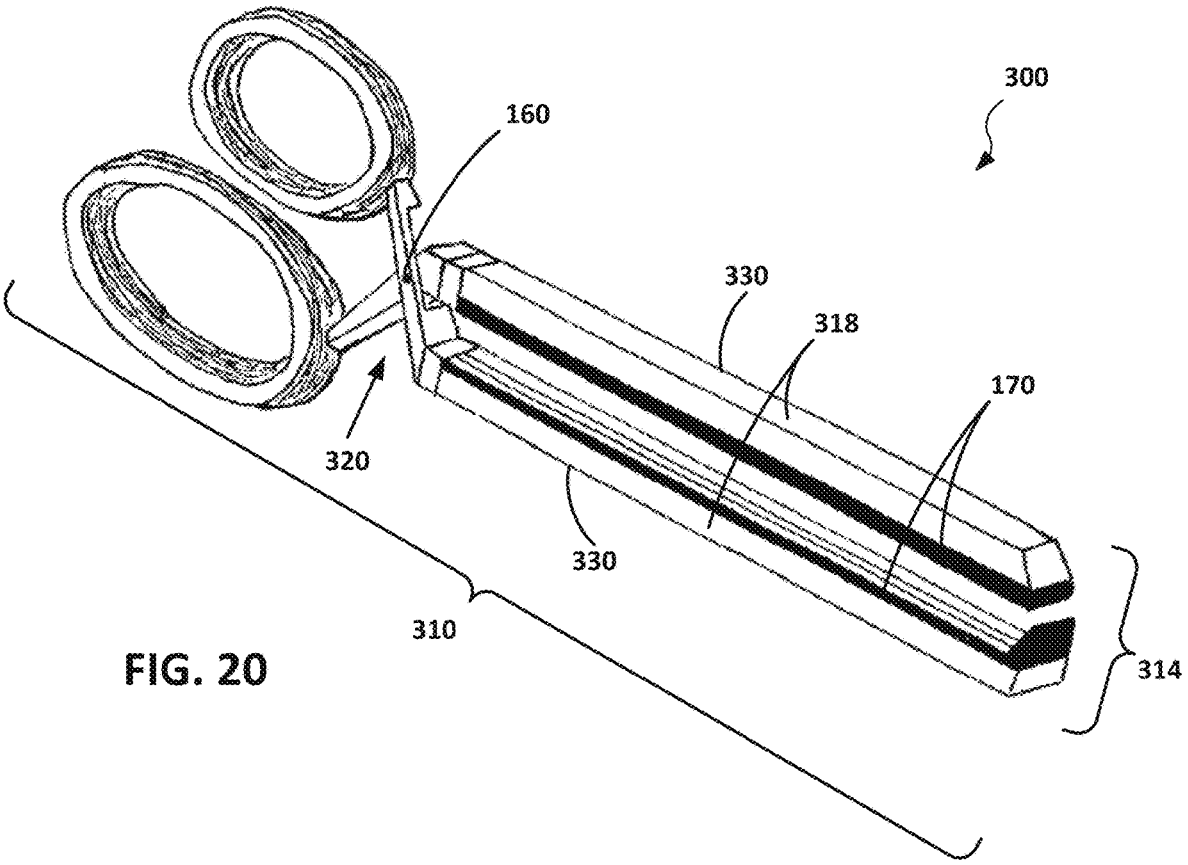
FIG. 20 is a perspective view of the third embodiment in the open position, showing the ridges of the grip surface.

Referring to FIGS. 15-22, the third embodiment 300 will be described. FIG. 20 depicts a perspective view of the third embodiment 300, which may have a different design compared to the first embodiment and the second embodiment. However, the third embodiment 300 may continue to serve the same purpose. A feature of the third embodiment 300 may be its scissor-like body 310. A jaw 314 of the body 310 may include a pair of wide arms 318 each housing a grip surface 170, which may facilitate holding the hair in place to protect against premature hair-loss. Thus, the third embodiment 300 may help facilitate combing or detangling hair.

Figure 16:
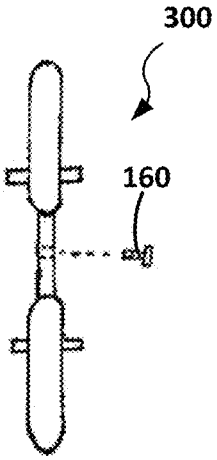
FIG. 16 is the rear elevational view of the third embodiment, showing a pin connecting the wide arms together.
Figure 22:
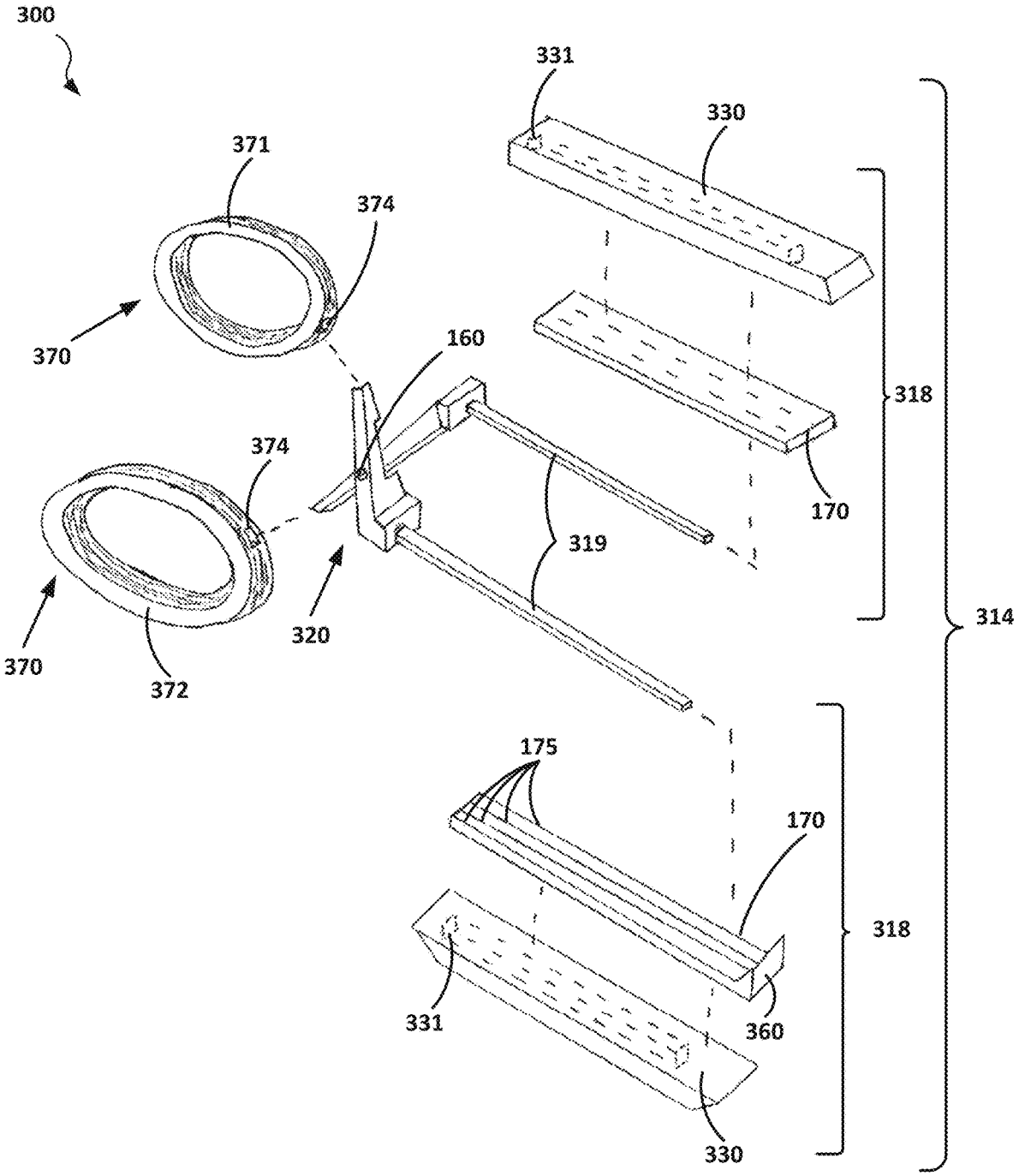
FIG. 22 is an exploded view of the third embodiment.

The wide arms 318, as depicted in FIG. 22, may be attachable to the body 310 and may provide structural support for the components of the third embodiment 300. In some embodiments, the wide arms 318 may comprise metal. The wide arms 318 may be connected at a pivot point 320 where a pin 160 (e.g., a metal pin) may secure the wide arms 318 together (as depicted in FIG. 16). The pivot point 320 where the pin 160 secures the wide arms 318 together may be seen in FIGS. 15 and 19. In some embodiments, the width of the wide arms 318 may be approximately 0.3 cm.

As shown in FIG. 20, an arm sleeve 330 may extend along a length of each of the wide arms 318 in the third embodiment 300. The arm sleeve 330 may be attached to the grip surfaces 170 of the third embodiment 300. Each arm sleeve 330 may be separately attached to each arm 319 of the wide arms 318, as depicted in FIG. 22, and secured to each of the wide arms 318 (e.g., with adhesive, integral locking features, fasteners, etc.). The arm sleeve 330 may have a sleeve hole 331 to removable or permanently receive and retain the arm 319 of the wide arms 318. Each arm sleeve 330 may be manufactured using a sturdy plastic material. In many instances, the wide arms 318 may include two (e.g., a pair) of arms.

Figure 17:
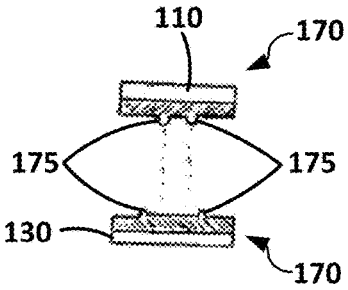
FIG. 17 is a cross sectional, side elevational view of the wide arms of the third embodiment, including ridges on the grip surface.
Figure 18:
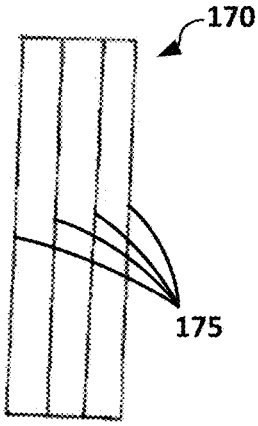
FIG. 18 is a top elevational view of the grip surface, including the ridges of FIG. 17.
Figure 19:
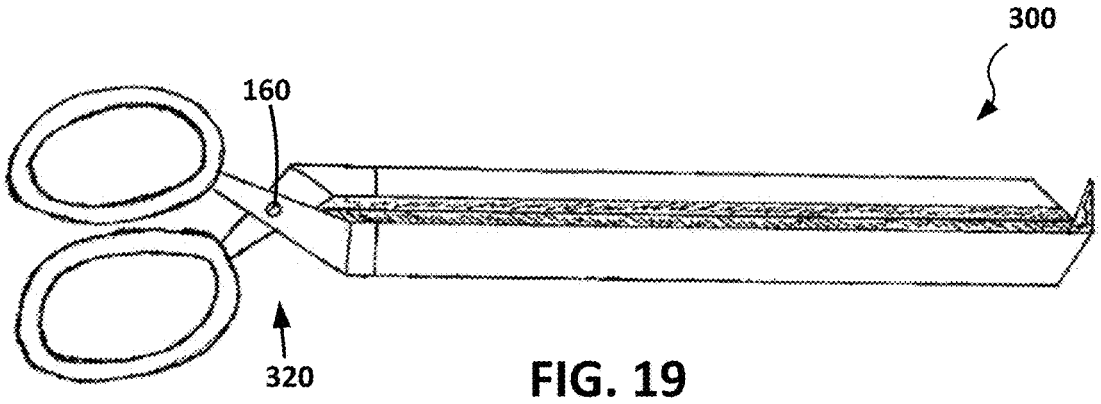
FIG. 19 is a right elevational view of the third embodiment in a closed position with the grip surface including an extension to help prevent the hair from slipping out of the device.

As explained above, each arm sleeve 330 in the third embodiment 300 may include attached grip surfaces 170, which may be used to help hold hair in place. The jaw 314, and thereby the grip surfaces 170 attached to the arm sleeve 330, of the third embodiment 300 may be moved between the closed position shown in FIG. 19 and the open position in FIG. 20. Similar to the first and second embodiments, the grip surface 170 for the third embodiment 300 may be of similar material and have the same ridges 175, with the only difference being the dimensions of the grip surface 170. As shown in FIGS. 17 and 18, the grip surfaces 170 of each of the wide arms 318 may be manufactured using a material that sufficiently inhibits movement of hair in contact with the grip surface 170 and/or between the wide arms 318, e.g., to prevent unintentional uprooting of hair by combing or detangling. The ridges 175 may be constructed as such to enhance this gripping of hair by the third embodiment 300.

The grip surface 170 of the third embodiment 300 may be unique because the grip surface 170 may include an extension 360 at a front end of the third embodiment 300. This extension 360 of the grip surface 170 may be used to prevent the hair from sliding out of the third embodiment 300 when the third embodiment 300 has been closed. Because it may be an integral feature of the grip surface 170, the extension 360 may be manufactured by the same material as the rest of the grip surface 170. In some embodiments, the width of the extension 360 may match the width of the arm sleeve 330 as depicted in FIG. 20, yet the height and length may be variable. In some embodiments, a length of one of the wide arms 318 may be greater than a length of another of the wide arms 318 to protect the hair from slipping out of the third embodiment 300. The longer of the wide arms 318 may include the extension 360.

As seen in FIG. 22, the third embodiment 300 may include one or more finger rings 370, which may be used to open and close the third embodiment 300. The one or more finger rings 370 may be manufactured from a rigid material (e.g., plastic) and may have an attachment hole 374, which may be used to attach each finger ring of the one or more finger rings 370 to one of the wide arms 318 of the third embodiment 300. An exploded depiction of this description is provided in FIG. 22. In some embodiments, the one or more finger rings 370 may be integrally manufactured with the wide arms 318 and may comprise the same or similar materials.

A method of use for the third embodiment 300 will now be described. In an example, the user may begin by inserting their thumb into a first finger ring 371 in the one or more finger rings 370 and as many fingers that fit comfortably into a second finger ring 372 in the one or more finger rings 370. Having more fingers in the second finger ring 372 may allow the user to better manipulate the third embodiment 300. As such, the third embodiment 300 may have a spacious second finger ring 372, e.g., such that it is larger than the first finger ring 371. The user may then open their hand, which may open the third embodiment 300 and may then place a hair section onto the grip surface 170. The user may spread the hair throughout the length of the grip surface 170 to ensure that as many hairs as possible may be in contact with the grip surface 170 to inhibit hair from moving relative to the grip surface 170. For this reason, the user may refrain from opening the third embodiment 300 while engaging in the combing or detangling procedure. Once the hair has been spread out, the user may hold their hair in place by closing their hand into a type of first to thereby close the third embodiment 300. If the user happens to open the third embodiment 300 in the middle of the combing process, they may have to repeat the above steps to hold the hair in place again. Once the hair is held by the third embodiment 300, the user may proceed with combing or detangling the hair, starting from the ends and proceeding toward the roots. Finally, the user may repeat this procedure for every section of hair until the user's entire head of hair has been combed or detangled.

Description of a Fourth Embodiment

Figure 23:
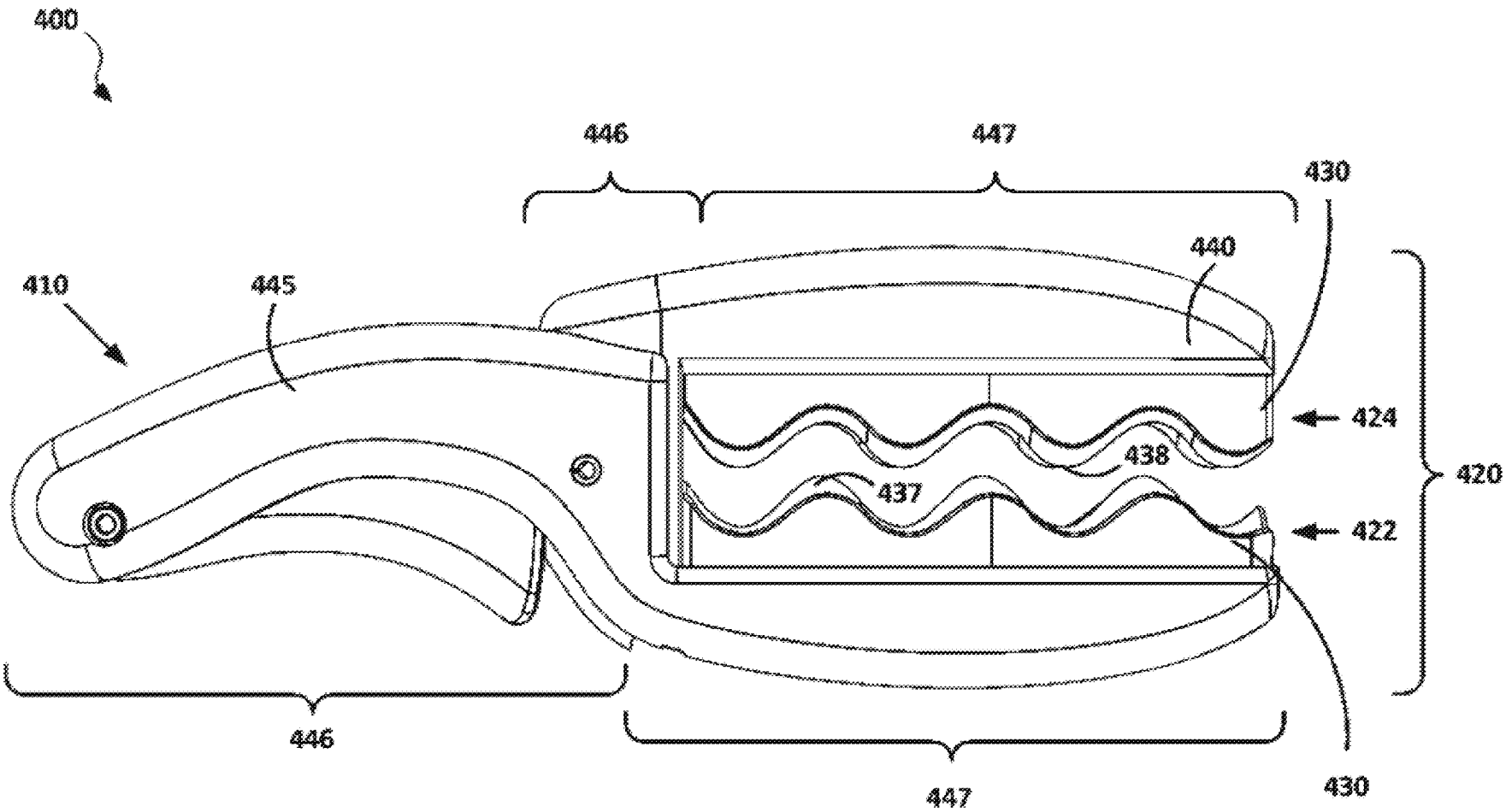
FIG. 23 is a right elevational view of the fourth embodiment in an open position.
Figure 24A:
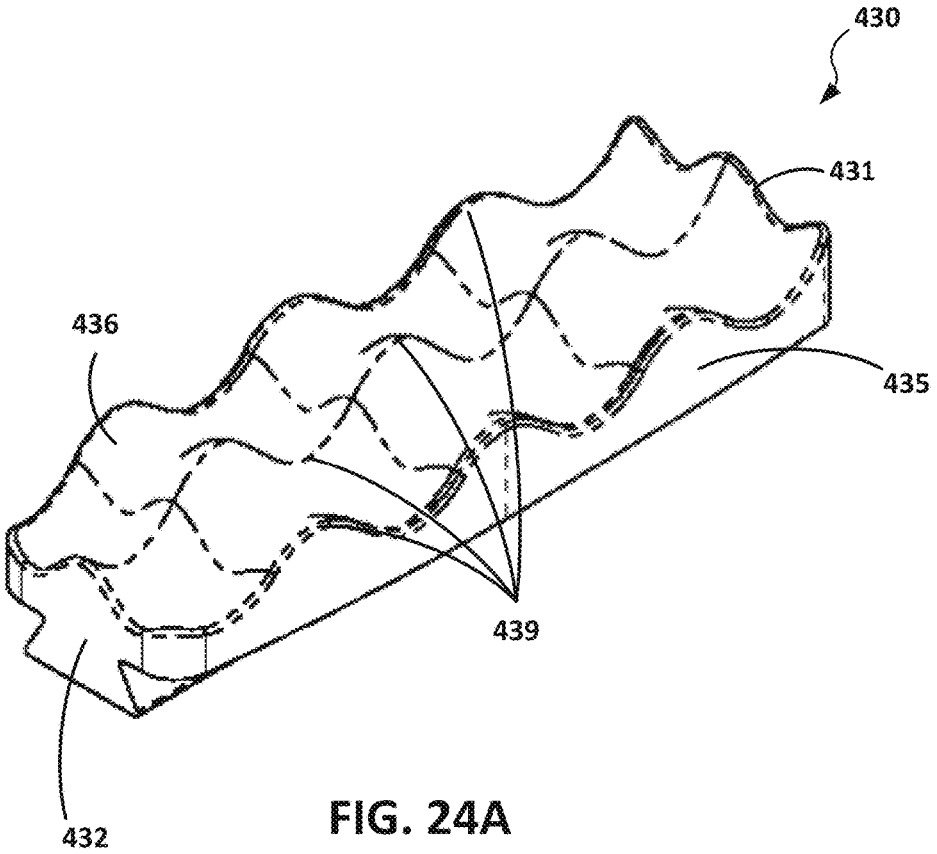
FIG. 24A is a perspective view of an illustrative grip, which may be a first jaw grip, including waves at a hair contact portion.
Figure 24B:
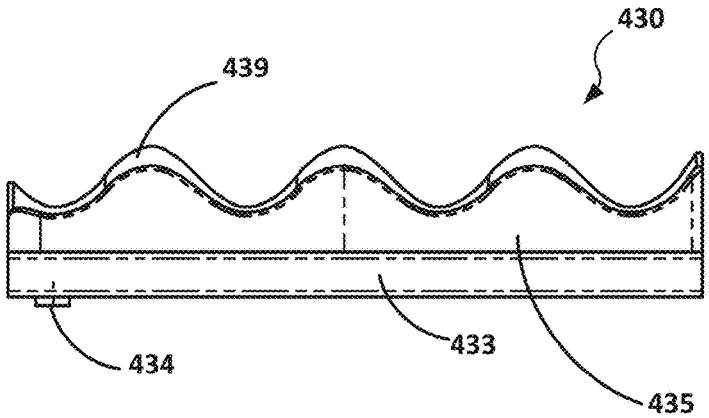
FIG. 24B is a right elevational view of the illustrative grip, which may be the first jaw grip, including waves at the hair contact portion.
Figure 24C:
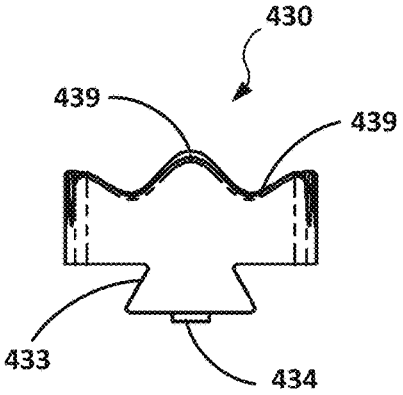
FIG. 24C is a front elevational view of the illustrative grip, which may be the first jaw grip, including waves at the hair contact portion.
Figure 25A:
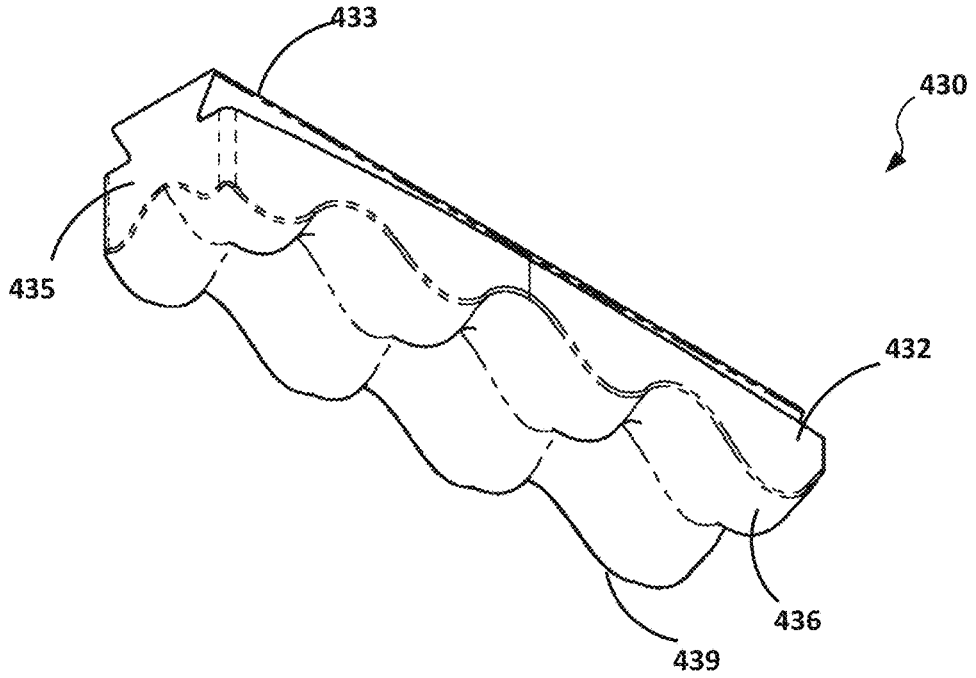
FIG. 25A is a perspective view of an illustrative grip, which may be a second jaw grip and may mate with the first jaw grip, including waves at the hair contact portion.
Figure 25B:
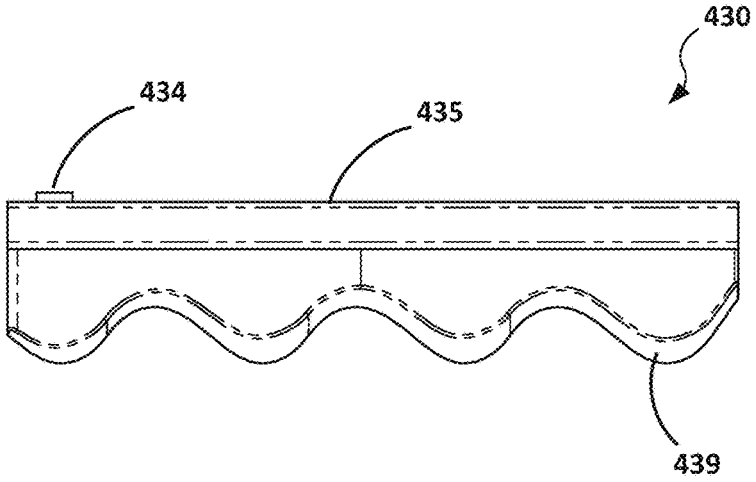
FIG. 25B is a right elevational view of an illustrative grip, which may be the second jaw grip and may mate with the first jaw grip, including waves at the hair contact portion.
Figure 25C:
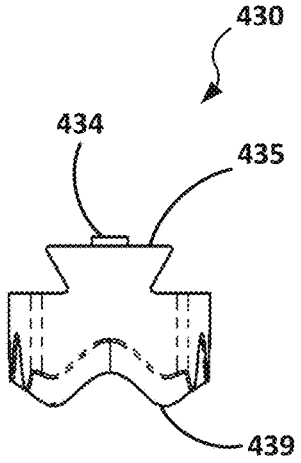
FIG. 25C is a front elevational view of an illustrative grip, which may be the second jaw grip and may mate with the first jaw grip, including waves at the hair contact portion.

A hair gripping device 400 as disclosed herein may hold hair during a combing procedure so as to minimize damage to an individual's hair and/or scalp. The hair gripping device 400, as shown in FIG. 23, may include a handle 410, a jaw 420, and a grip 430. The handle 410 may be connected to the jaw 420, and the grip 430 may be retained within the jaw 420. In operation, a user may wield and control portions of the hair gripping device 400 to hold a plurality of hair strands within the jaw 420. For instance, the handle 410 may be connected to the jaw 420 such that, with actuation of the handle 410, the jaw 420 can move between an open position in which the grip 430 inhibits movement of a plurality of hair strands relative to the jaw 420 and a closed position in which the grip 430 does not inhibit movement of a plurality of hair strands relative to the jaw 420. A user may then, during a combing operation, separate a bundle of hair containing a plurality of hair strands, place the hair gripping device 400 at a position proximal to the roots of the plurality hair strands in the bundle of hair, hold the bundle of hair with the hair gripping device 400, and brush or comb the non-held portion of hair distal to the hair gripping device 400 and the roots of the plurality of hair strands in the bundle of hair.

Some hair gripping devices 400 may include both a first arm 440 and a second arm 445, which may form the handle 410 and the jaw 420. The first arm 440 may have a first handling portion 441 and a first clamping portion 442, which may be opposite the first handling portion 441. The second arm 445 may have a second handling portion 446 and a second clamping portion 447, which may be opposite the second handling portion 446. The second arm 445 may connect to the first arm 440, for example, positioning the first clamping portion 442 alongside the second clamping portion 447 and the first handling portion 441 alongside the second handling portion 446. The jaw 420 of the hair gripping device 400 may include the first clamping portion 442 and may include the second clamping portion 447. The first arm 440 and the second arm 445 may comprise, for example, a semi-rigid or rigid material now known or later developed. In some embodiments, the hair gripping device 400 may move toward the closed position when the first clamping portion 442 moves toward the second clamping portion 447, for example, by actuating the handle 410. The hair gripping device 400 may move toward the open position when the first clamping portion 442 is moved away from the second clamping portion 447 with actuation of the handle 410. In some embodiments, the jaw 420 may move between the open position and closed position with the first clamping portion 442 in parallel to the second clamping portion 447. Some embodiments may have the first arm 440, the second arm 445, or both surround the bundle of hair with a clamping force, and in such instances, the clamping force may be proportional to an amount of force used to actuate the handle 410 of the hair gripping device 400 and may be transferred in proportion to other components of the hair gripping device 400, such as the grip 430.

The grip 430, as shown in FIGS. 24A-24C and 25A-25C, may be received within the jaw 420 and oriented such that a portion of the grip 430 is connected to the jaw 420 and a portion of the grip 430 contacts the bundle of hair within the jaw 420 to hold the hair during the combing operation. The grip 430 may include a top portion 431, a bottom portion 432, and lateral sides 435 extending between the top portion 431 and the bottom portion 432. In many embodiments, the grip 430 may comprise elastomer (e.g., rubber, silicone, etc.), polymers (e.g., plastic, resins, etc.), or other malleable materials; tacky materials or coatings (e.g., cloth, adhesives, etc.); and the like now known or later developed. As discussed elsewhere herein, the bottom portion 432 of the grip 430 may be configured to be received and retained within the jaw 420 of the hair gripping device 400. The grip 430 may inhibit movement of a bundle of hair within the jaw 420 and thereby hold the plurality of hair during the combing procedure. The grip 430 may be configured to hold a plurality of hair strands when the jaw 420 is in the closed position and to not hold a plurality of hair strands when the jaw 420 is in the open position.

Features of the grip 430 may facilitate retaining the grip 430 within the jaw 420, orienting the grip 430 within the jaw 420, or both. An outer profile of the bottom portion 432 of the grip 430 may include a spine 433. The spine 433 may extend along a majority of the length of the bottom portion 432. In some embodiments, the outer profile of the spine 433 may complement the shape of the inner profile of a slot 315 (best seen in FIG. 28) of the jaw 420. In some embodiments, the slot 315 of the jaw 420 may be configured to receive the spine 433 which may connect the grip 430 to the jaw 420. In some embodiments, the grip 430 may be removably connected to the jaw 420. In other embodiments, the grip 430 may be integral to or fixedly connected to the jaw 420.

The grip 430 of the hair gripping device 400 may be retained in the jaw 420 via a retaining mechanism. For example, the retaining mechanism can include a stop 434 on the bottom portion 432 that may be configured to prevent movement of the spine 433 within the slot 315 when the spine 433 is received within the jaw 420. The stop 434 may be a raised feature rising from an outer surface of the bottom portion 432 and may be received within a mating aperture of the slot 315 when properly positioned within the slot 315 or not received within the mating aperture of the slot 315 when not properly positioned within the slot 315. The stop 434 may be a recessed feature recessing from the outer surface of the bottom portion 432 and may be engaged by a raised bump of the slot 315 when properly positioned within the slot 315 or not engaged by the raised bump of the slot 315 when not properly positioned within the slot 315. Many embodiments of the hair gripping device 400 may include one or more stops or integral attachment features which retain the grip 430 in the jaw 420.

Features of the grip 430 may facilitate holding the bundle of hair or not during the combing procedure. The top portion 431 of the grip 430 may be configured to allow the jaw 420 to hold a plurality of hair strands, for example, at a hair contact portion 436 of the top portion 431. In such instances, movement of a majority of the plurality of hair strands within the hair contact portion 436 may be inhibited when the jaw 420 is in the closed position and movement of a majority of the plurality of hair strands within the hair contact portion 436 may not be inhibited when the jaw 420 is in the open position.

A shape of the hair contact portion 436 of the grip 430 may be configured to facilitate holding the plurality of hair strands. In many embodiments, the outer profile of the top portion 431 of the grip 430 may include one or more waves 439. In some embodiments, the one or more waves 439 of the top portion 431 of the grip 430 may include a plurality of waves 439. The grip 430 may include a first wave of the plurality of waves 439 and a second wave of the plurality of waves 439. In some embodiments, the first wave of the plurality of waves 439 may include a first height. In some embodiments, the second wave of the plurality of waves 439 may include a second height that is different from the first height.

The jaw 420 of the hair gripping device 400 may be configured to hold a plurality of hair strands at a first hair contact portion 437 of a first jaw grip 422. The first jaw grip 422 may be similar to the grips described elsewhere herein. In such an embodiment, for example, the first jaw grip 422 may include a first hair contact portion 437 and be positioned on the first clamping portion 442 or the second clamping portion 447 such that, when in the closed position, hair may be held between the first jaw grip 422 and whichever of the first clamping portion 442 or second clamping portion 447 does not include the first jaw grip 422. In such instances, portions of the first jaw grip 422 may mate with and be complementary to the shape of whichever of the first clamping portion 442 or second clamping portion 447 does not include the first jaw grip 422.

In some embodiments, as can be seen in FIGS. 23, 26A, 26B, 27A, and 27B, the jaw 420 may include the first jaw grip 422 and a second jaw grip 424 that is similar to the grips described elsewhere herein. Thus, the first jaw grip 422 may include a first hair contact portion 437 and may be connected to the first clamping portion 442 or the second clamping portion 447. In such embodiments, the second jaw grip 424 may include a second hair contact portion 438 and may be connected to the other of the first clamping portion 442 or the second clamping portion 447 that does not include the first jaw grip 422. In such instances, portions of the first jaw grip 422 may mate with and be complementary to the shape of the second jaw grip 424. For instance, the first hair contact portion 437 and the second hair contact portion 438 may be configured to mate with each other and have complementary shapes such that minimal space exists between them when the jaw 420 is in the closed position, mating them together. In such instances, during a combing procedure, the bundle of hair can be held between the first hair contact portion 437 and the second hair contact portion 438.

Figure 26B:
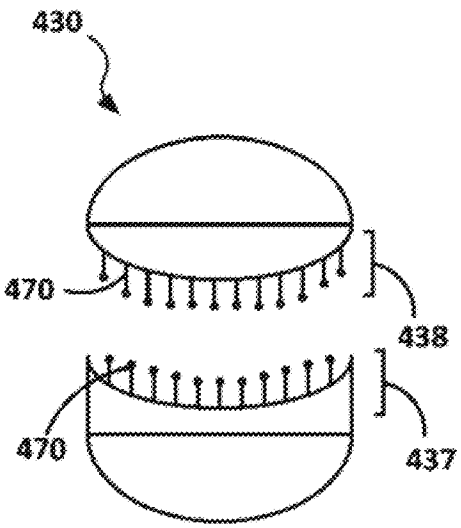
FIG. 26B is a front elevational view of the fourth embodiment with the grip including bristles.
Figure 26A:
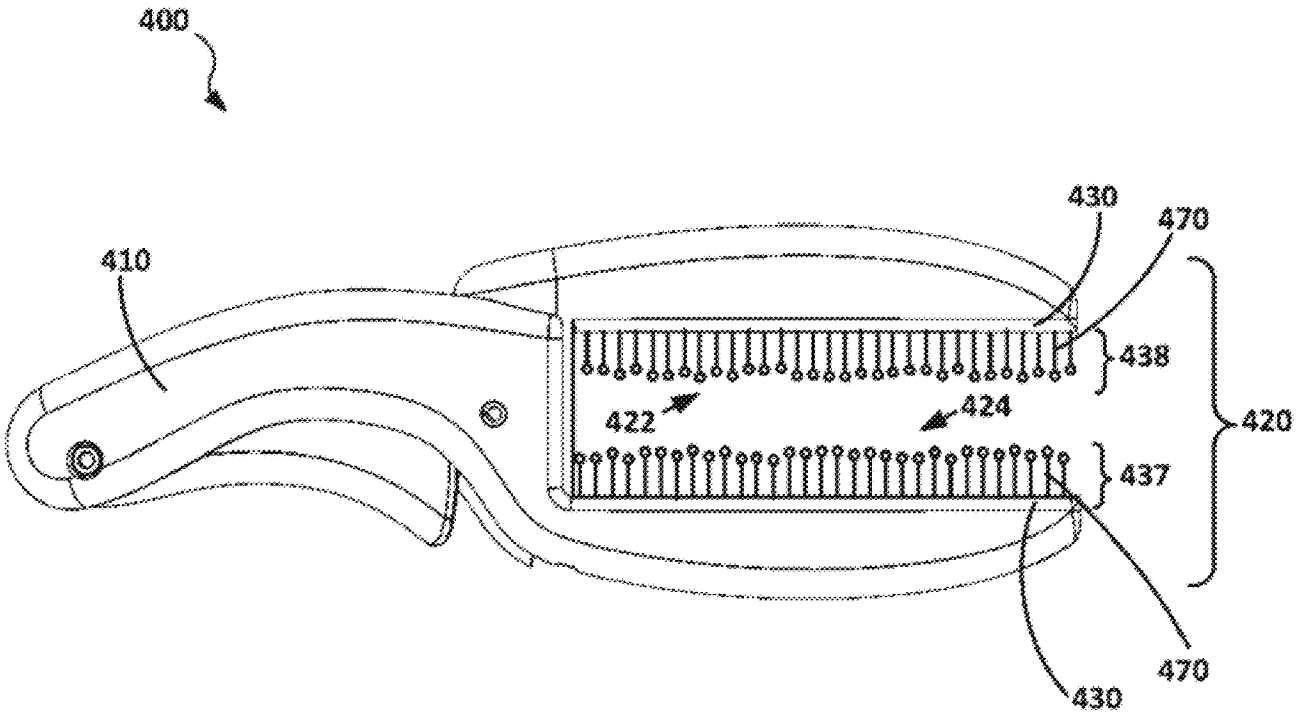
FIG. 26A is a right elevational view of the fourth embodiment with the grip including bristles.
Figure 27A:
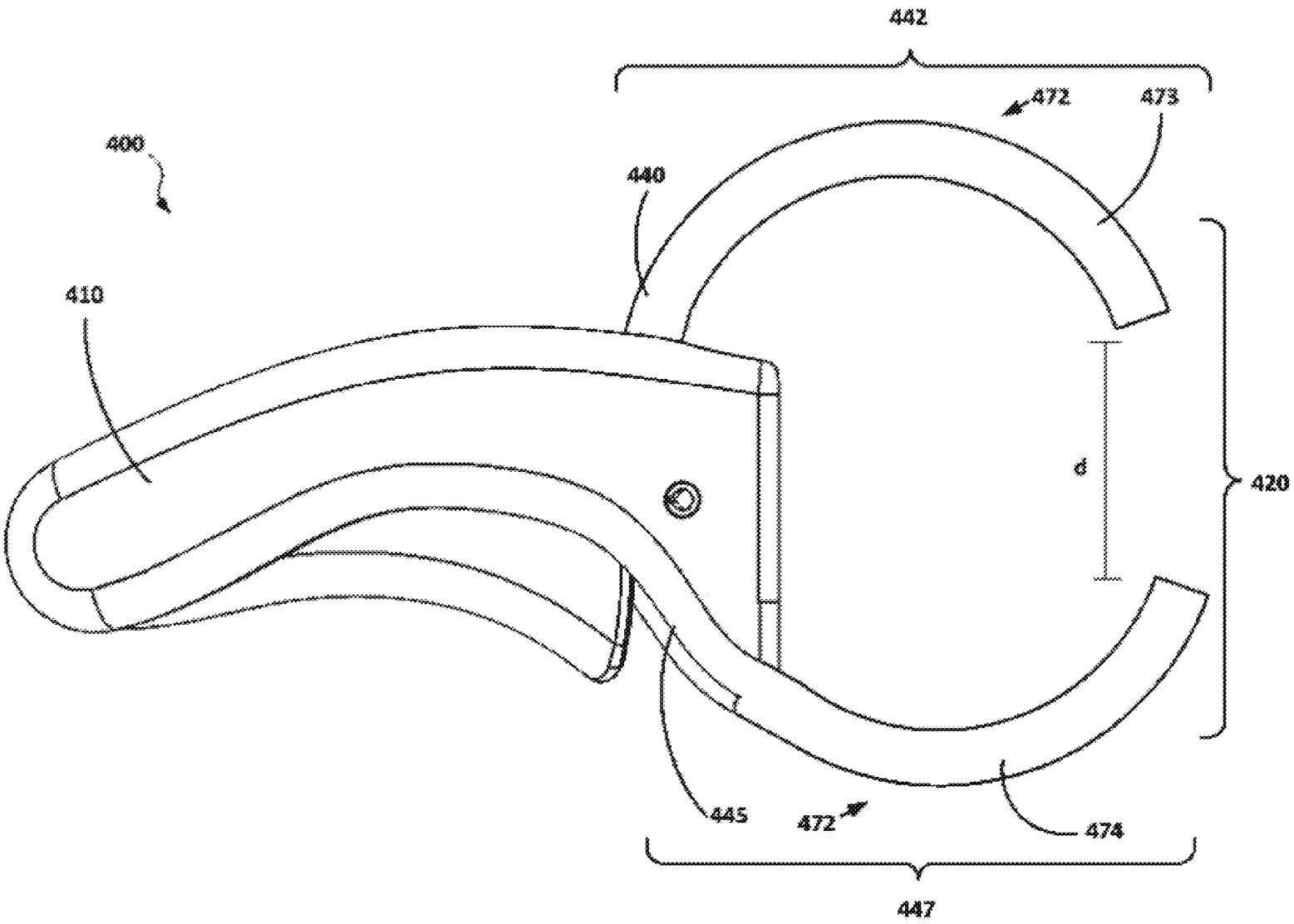
FIG. 27A is a right elevational view of the fourth embodiment in an open position with a first clamping portion of a first arm and a second clamping portion of a second arm being first and second curling arms respectively and being oriented parallel to a length of the a second track of the actuator.
Figure 27B:
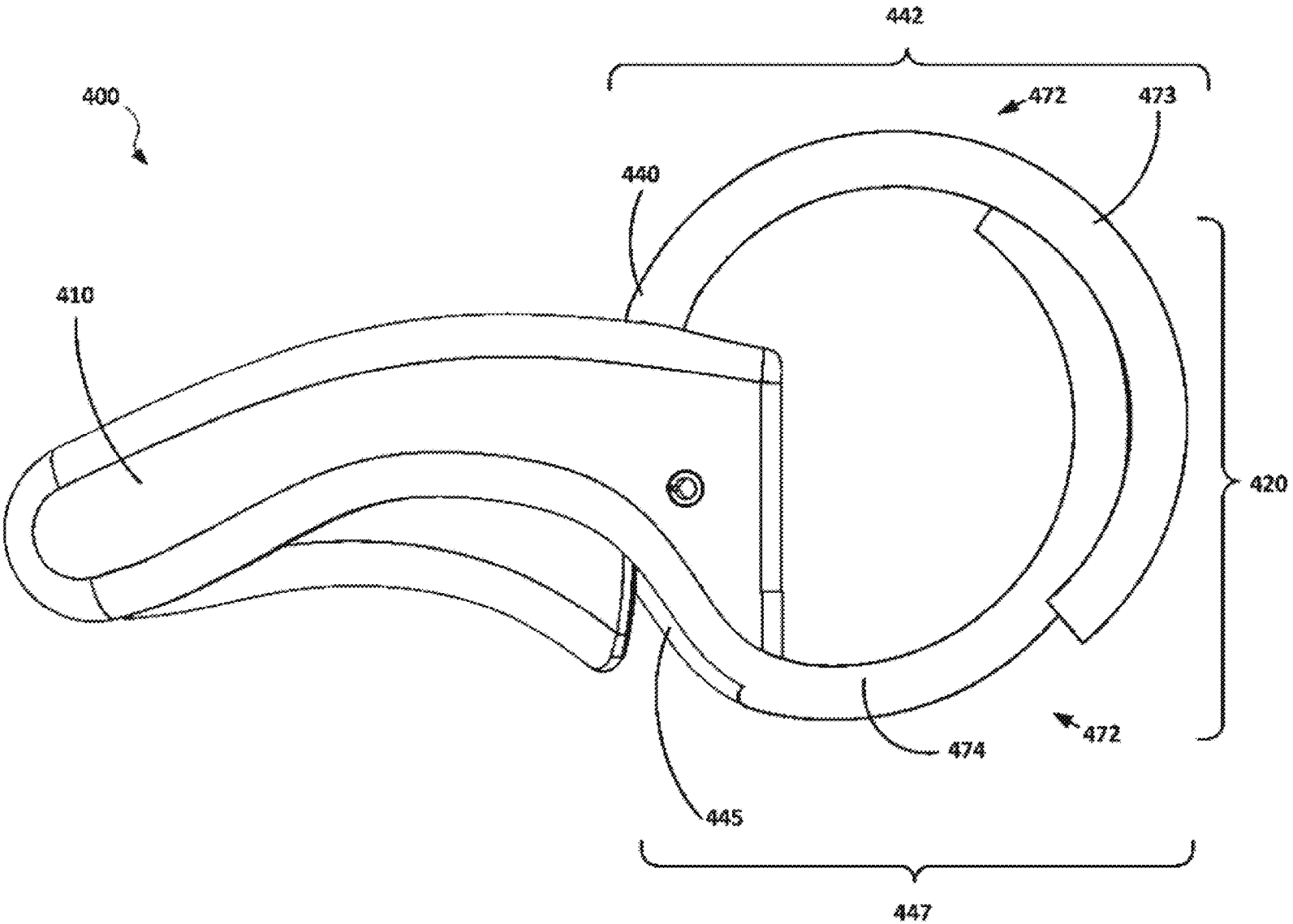
FIG. 27B is a right elevational view of the fourth embodiment in a closed position with the first clamping portion of the first arm and the second clamping portion of the second arm being first and second curling arms respectively and being oriented parallel to a length of the a second track of the actuator.
Figure 27C:
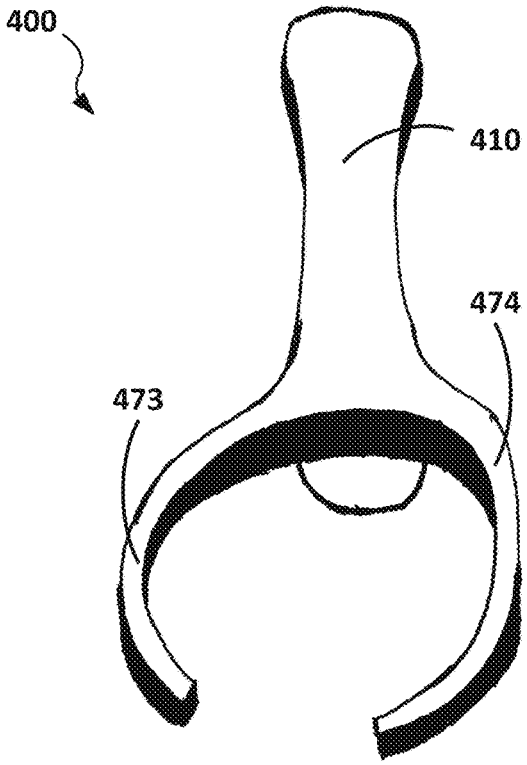
FIG. 27C is a top view of the fourth embodiment in an open position with the first clamping portion of the first arm and the second clamping portion of the second arm being first and second curling arm respectively and being oriented perpendicular to a length of the a second track of the actuator.
Figure 27D:
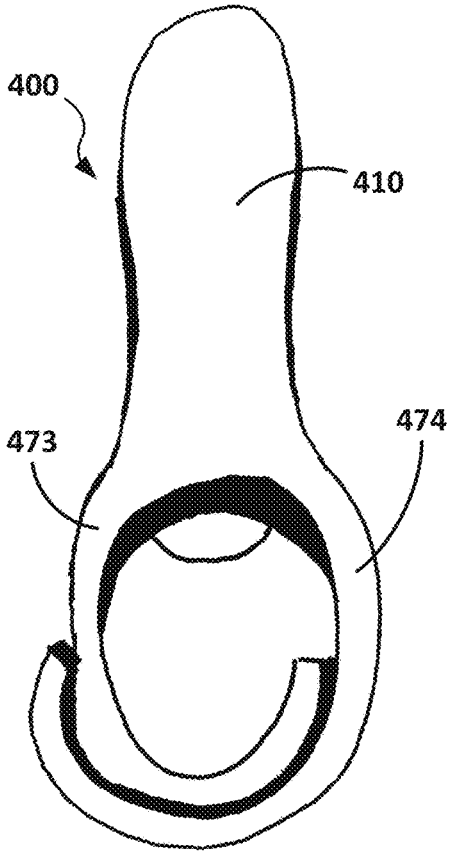
FIG. 27D is a perspective view of the fourth embodiment in a closed position with the first clamping portion of the first arm and the second clamping portion of the second arm being the first and second curling arm respectively and being oriented perpendicular to a length of the a second track of the actuator.
Figure 27E:
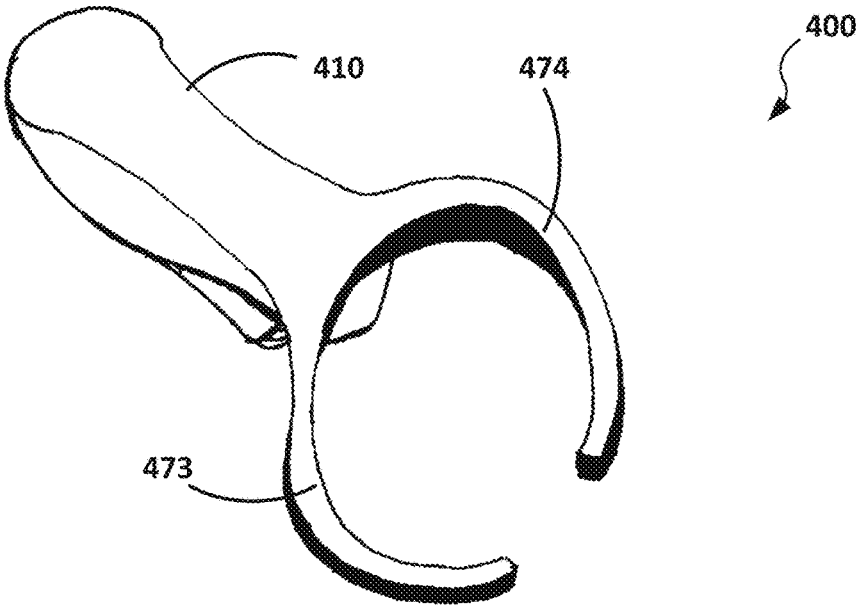
FIG. 27E is a perspective view of the fourth embodiment in an open position with the first clamping portion of the first arm and the second clamping portion of the second arm being the first and second curling arm respectively and being oriented perpendicular to a length of the a second track of the actuator.

In many instances, the grip 430 can include a plurality of bristles 470 as shown in FIGS. 26A and 26B. When the hair gripping device 400 includes the first jaw grip 422 and the second jaw grip 424, each bristle in the plurality of bristles 470 may interlock with one another when the jaw 420 is in the closed position. This arrangement may prevent movement of hair strands surrounding each bristle in the plurality of bristles 470 from moving relative to the first jaw grip 422 and the second jaw grip 424. Some bristles in the plurality of bristles 470 may have variable dimensions (length, size, diameter, etc.).

In some instances, as shown in FIGS. 27A-27E, the jaw 420 can include one or more curling arms 472 configured to wrap around a bundle of hair strands. For example, in instances where the hair gripping device 400 includes the first arm 440 and the second arm 445, the first clamping portion 442 of the first arm 440 may be a first curling arm 473 and the second clamping portion 447 of the second arm 445 may be a second curling arm 474. When in the open position, the first curling arm 473 and the second curling arm 474 can be separated by a distance, "d," that is wide enough to allow for a user to insert a bundle of hair strands between the first curling arm 473 and the second curling arm 474. When in the closed position, the first curling arm 473 and the second curling arm 474 may curl toward the other so as to surround the inserted bundle of hair strands. Some embodiments may have the curling arms 472 surround the bundle of hair strands with a clamping force, and in such instances, the clamping force may be proportional to an amount of force used to actuate the handle 410 of the hair gripping device 400. Some curling arms 472 may have their length be oriented substantially parallel to a length of a second track of the actuator (as disclosed elsewhere herein) while some curling arms 472 may have their length be oriented substantially perpendicular to the length of the second track of the actuator (as disclosed elsewhere herein).

Figure 28:
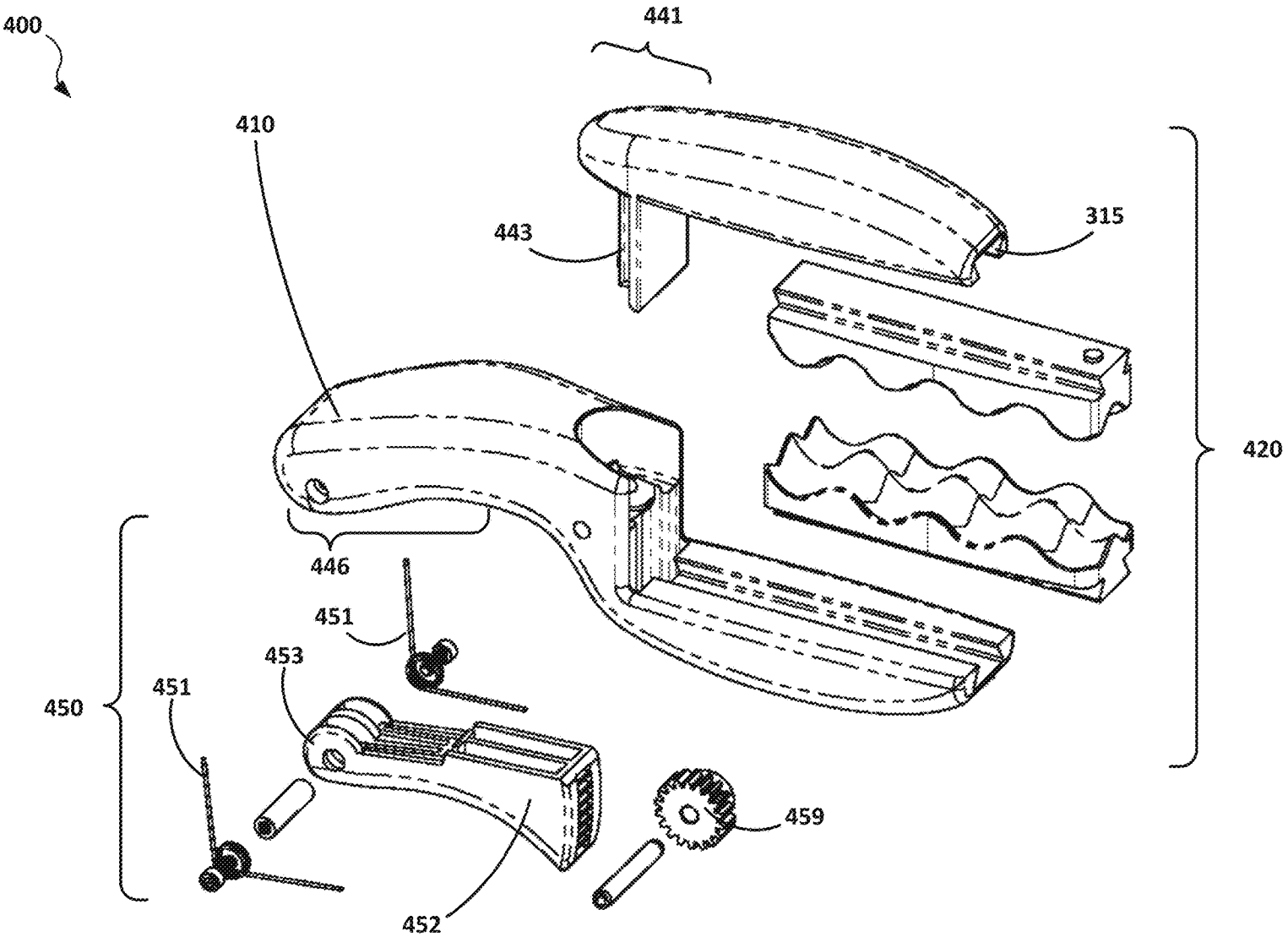
FIG. 28 is an exploded view of the fourth embodiment, showing the actuator assembly.
Figure 29:
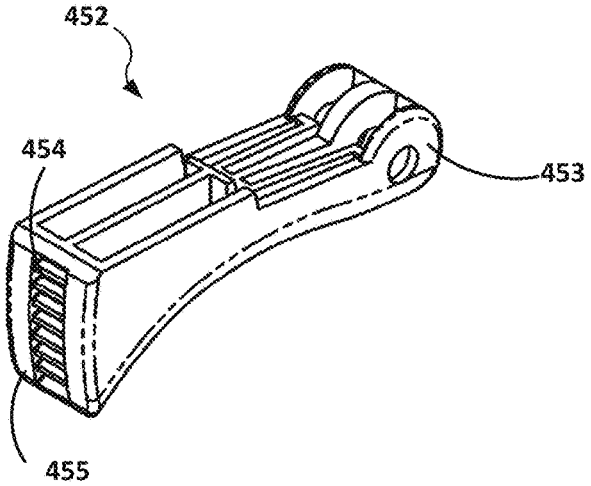
FIG. 29 is a perspective view of an actuator, including a pivot end and a second track at a second track end.
Figure 31:
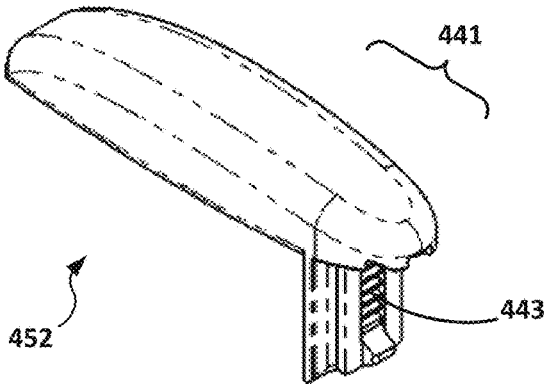
FIG. 31 is a perspective view of the first arm having a first track at the first handling portion of the first arm.
Figure 30:
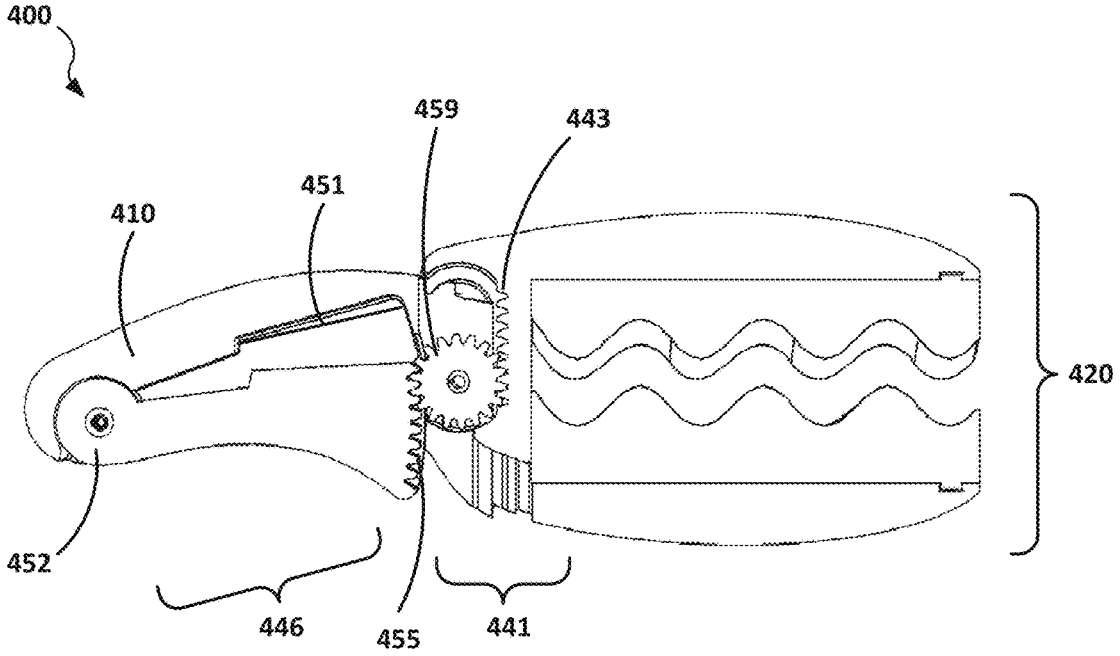
FIG. 30 is a cross sectional side elevational view of the handle and actuator assembly of the fourth embodiment.

Referring to FIG. 28, the handle 410 of the hair gripping device 400 can be used to wield and control portions of the hair gripping device 400 to hold a plurality of hair strands within the jaw 420. In some embodiments, a handle 410 of the hair gripping device 400 may include the first handling portion 441, the second handling portion 446, or both. In any case, the handle 410 may be ergonomically designed to be comfortably held by the hand of a user. For example, as disclosed elsewhere herein, the handle 410 may have an ergonomic shape that will facilitate gripping of the handle 410 and actuating the handle 410. In various embodiments, the longitudinal cross section of the first handling portion 441, the second handling portion 446, or both may be wavelike (as can be seen in FIGS. 32-33).

In some embodiments, the hair gripping device 400 may include an actuator assembly 450 configured to move the jaw 420 between the closed position and the open position. The actuator assembly 450 can include an actuator 452, which may be movably (e.g., pivotably, slidably, etc.) connected to the handle 410. In some embodiments, actuating the handle 410 may include moving the actuator 452, which may cause the jaw 420 to move between the closed position and the open position. For example, compressing the actuator 452 may cause the jaw 420 to move into the closed position and releasing or pulling the actuator 452 may cause the jaw 420 to move into the open position. Although discussed and/or depicted in a particular position, one skilled in the art may appreciate that the actuator 452 may be positioned at any location about the handle 410 (e.g., top, bottom, end, sides, etc.).

Referring to FIGS. 28-31, a gear 459 of the actuator assembly 450 may translate movement of the actuator 452 to movement of the jaw 420. In some embodiments, the actuator 452 may be pivotably connected to the handle 410 at a pivot end 453 of the actuator 452. In many embodiments, the actuator assembly 450 may include a torsional biasing member 451 (e.g., spring, compressible membrane, etc.), which may be coupled between the handle 410 and the actuator 452 and which may bias the actuator 452 in a non-compressed position. Opposite the pivot end 453, a second track 454 may be included at a second track end 455 of the actuator 452. The gear 459, which may be rotationally connected (e.g., via a pin) to the handle 410, may be engagingly coupled between a first track 443 at the first handling portion 441 and the second track 454. In any of these instances, the gear 459 may be connected to the first track 443 and the second track 454 such that pivoting movement of the actuator 452 rotates the gear 459 to travel along the first track 443 of the actuator 452 and the second track 454 of the first handling portion 441, thereby moving the jaw 420 between the open position and the closed position. For instance, compressing the actuator 452 may cause the gear 459 to rotate a first rotational direction and thereby move the jaw 420 into the closed position and releasing the actuator 452 thereafter may cause the gear 459 to rotate in a second rotational direction and thereby move the jaw 420 into the open position. One skilled in the art can appreciate that the first track 443 and the second track 454 may be at a variety of locations on the hair gripping device 400 without departing from the scope of this disclosure.

Figure 32:
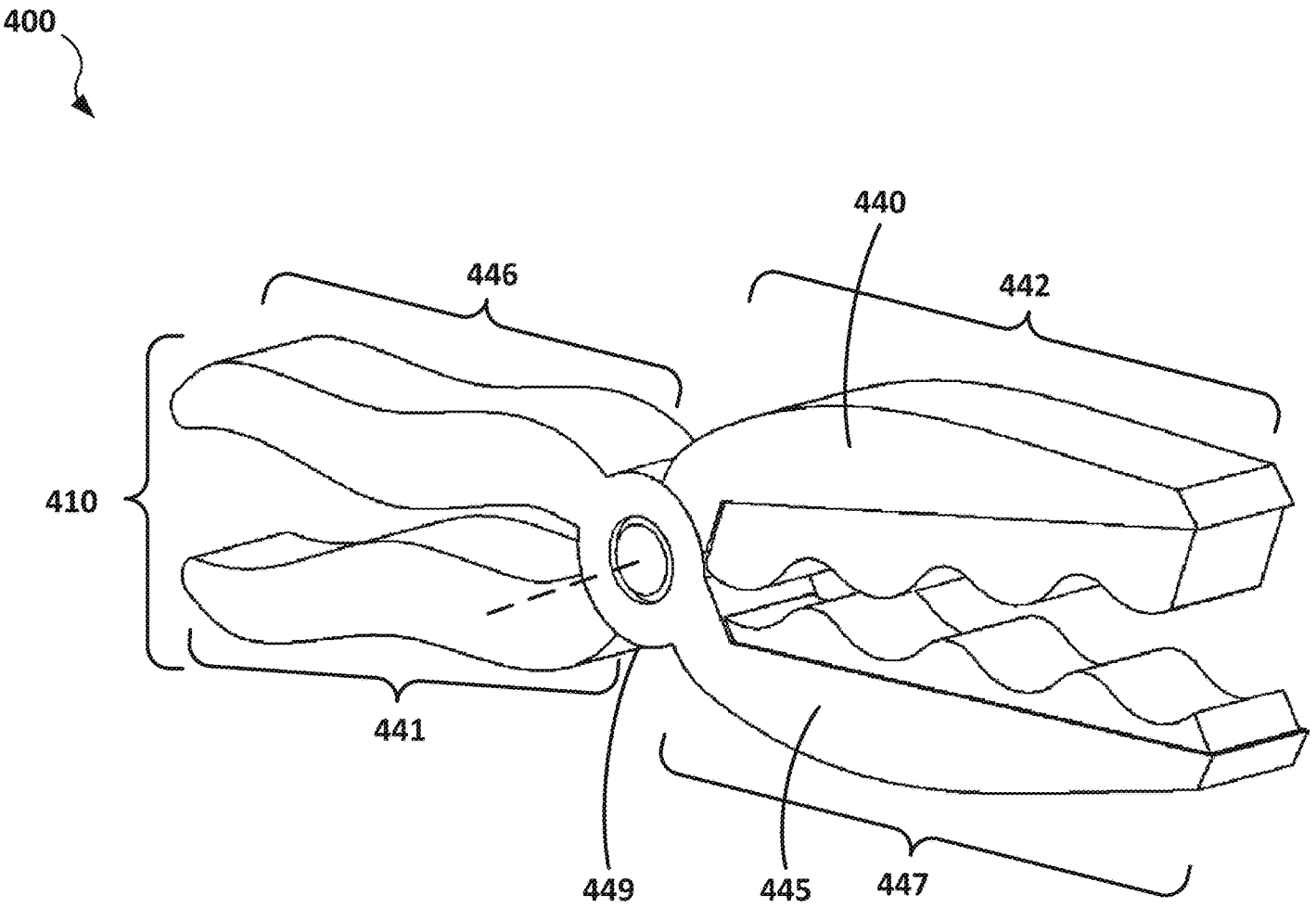
FIG. 32 is a perspective view of the fourth embodiment with the first arm and the second arm connected at a junction.
Figure 33:
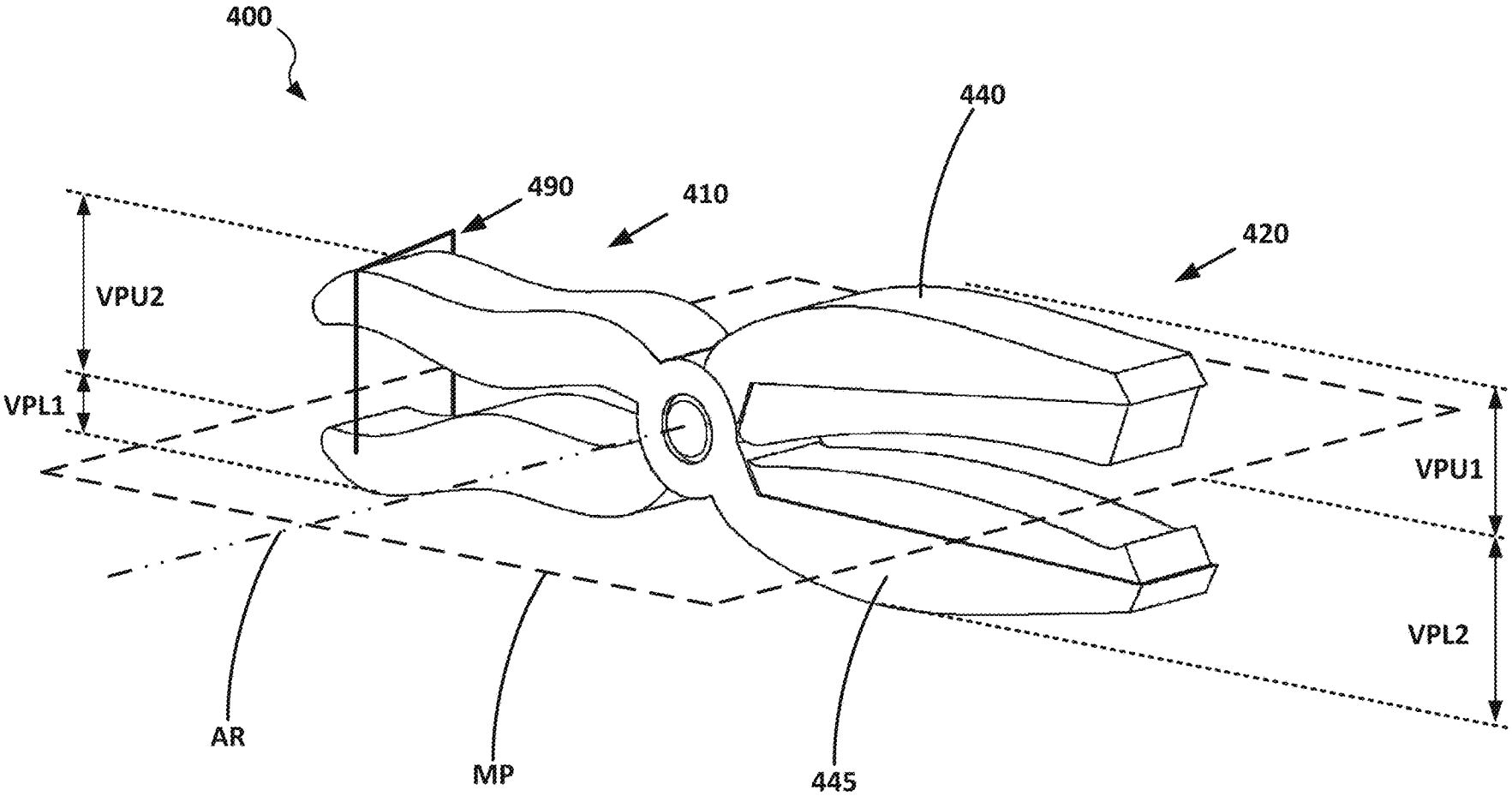
FIG. 33 is a perspective view of the fourth embodiment with the first arm and the second arm connected at the junction and with a midplane extending along a length of the hair gripping device and along an axis of rotation of the junction.

In some embodiments, as seen in FIG. 32, the second arm 445 may be rotatably coupled to the first arm 440 at a junction 449 located along the length of the first arm 440 and the second arm 445. Such embodiments of the hair gripping device 400 may be devoid of an actuator assembly. In many embodiments, the junction 449 may be substantially at the midpoint of the first arm 440 and the second arm 445. For example, the junction 449 can be between the first clamping portion 442 and the first handling portion 441 of the first arm 440 and the second clamping portion 447 and the second handling portion 446 of the second arm 445. The junction 449 may include an integral attachment feature of the first arm 440 and the second arm 445. The hair gripping device 400, in various embodiments, may have the first arm 440 and the second arm 445 be removably connected to each other at the junction 449.

As can be seen in FIG. 33, the overall profile of the hair gripping device 400 may be compact. When in the closed position, the overall profile of the hair gripping device 400 may be substantially rectangular. For example, in some embodiments, the hair gripping device 400 may include a midplane, "MP," which may extend along the length of the device and along the length of an axis of rotation, "AR." In some embodiments, when the hair gripping device 400 may be in the closed position, the vertical position of the uppermost point of the first arm 440, "VPU1," from the midplane may not substantially exceed that of an uppermost point of the second arm 445, "VPU2." When the hair gripping device 400 may be in the closed position, the vertical position of the lowermost point of the second arm 445, "VPL2," from the midplane may not substantially exceed that of the lowermost point of the first arm 440, "VPL1." In some instances, the overall profile of the hair gripping device 400 may be another polygonal shape.

In some embodiments, the hair gripping device 400 may include a clasp 490 connected to either the first arm 440 or the second arm 445. Embodiments of the clasp 490 may include, for example, a hoop connected to one of the first arm 440 or second arm 445 and configured to removably retain the other of the first arm 440 or second arm 445. Some clasps may be similar to the adjustable lock as disclosed elsewhere herein while other clasps may take any number of other forms that perform a similar function (e.g., a hoop, a hook, etc.). In any case, the clasp 490 may be configured to keep the hair gripping device 400 in the closed position, e.g., by securing the handle 410 or the jaw 420 in the closed position or substantially in the closed position. The clasp 490 may also help to protect the grip 430 from damage, e.g., from some contaminants that may otherwise settle in between two grips.

A hair gripping device and associated methods have been described in connection with exemplary embodiments and exemplary preferred embodiments and implementations, as examples only. It will be understood by those having ordinary skill in the pertinent art that modifications to any of the embodiments or preferred embodiments may be easily made without materially departing from the scope of the appended claims.

What is claimed is:

1. A hair gripping device comprising:

a handle;

a jaw connected to the handle, the jaw being defined by a first clamping portion that is operatively arranged opposite a second clamping portion and configured to receive and clamp a plurality of hair strands between the first and second clamping portions;

an actuator assembly operatively coupled to the handle such that actuation of the actuator assembly by movement of the first clamping portion and second clamping portion provides uniform translation of the first and second clamping portions of the jaw between the closed position and the open position such that actuation of the handle is about a single pivot point such that the first and second clamping portions remain parallel to each other; and a jaw grip disposed at the jaw;

wherein the jaw grip is configured to hold the plurality of hair strands at a hair contact portion of the jaw grip such that movement of a majority of the plurality of hair strands within the hair contact portion is inhibited when the jaw is in the closed position and movement of a majority of the plurality of hair strands within the hair contact portion is not inhibited when the jaw is in the open position; and wherein when in the closed position, the device imparts a holding strength on the plurality of hair strands such that movement of the plurality of hair strands proximal to the device is minimized to thereby mitigate uprooting during styling of the plurality of hair strands distal to the device.

2. The hair gripping device of claim 1, wherein the jaw grip comprises first and second jaw grips, the hair contact portion being integrated into the first jaw grip to form a first hair contact portion that complementarily mates with a second hair contact portion of the second jaw grip.

3. The hair gripping device of claim 1, wherein a majority of the jaw grip comprises elastomer.

4. The hair gripping device of claim 1, wherein a shape of the hair contact portion of the first jaw grip is configured to facilitate holding the plurality of hair strands.

5. The hair gripping device of claim 4, wherein a cross section of the hair contact portion is variable.

6. The hair gripping device of claim 4, wherein a cross section of the hair contact portion includes one or more waves.

7. The hair gripping device of claim 1, wherein the jaw grip is removably connected to the jaw.

8. The hair gripping device of claim 1, further comprising a first arm having a first handling portion and the first clamping portion positioned opposite the first handling portion and a second arm connected to the first arm and having a second handling portion and the second clamping portion positioned opposite the second handling portion.

9. The hair gripping device of claim 8, wherein the closed position is achieved when the first clamping portion is moved toward the second clamping portion with actuation of the acuator assembly and the open position is achieved when the first clamping portion is moved away from the second clamping portion.

10. The hair gripping device of claim 9, further comprising a handle, wherein the handle comprises the actuator assembly with an actuator pivotably connected to the handle, wherein the actuator assembly is configured to move the jaw between the closed position and the open position by actuating the handle with pivoting movement of the actuator.

11. A grip for a hair gripping device, the grip comprising:

a first grip surface;

a second grip surface; and the first and second grip surfaces being operatively connectible to an actuator assembly that, with actuation of the actuator assembly, results in uniform translation of the first and second grip surfaces between a closed position and an open position such that the first and second grip surfaces remain parallel to each other;

wherein the first and second grip surfaces mate to grip a plurality of hair strands; and wherein translating the first and second grip surfaces into the closed position includes imparting a holding strength to thereby hold the plurality of hair strands such that movement of the plurality of hair strands proximal to the grip is minimized to mitigate uprooting during styling of the plurality of hair strands distal to the grip.

12. The grip of claim 11, wherein the first grip surface and the second grip surface contain mating ridges.

13. The grip of claim 11, wherein the grip is removably couplable to a hair gripping device.

14. The grip of claim 11, wherein an outer profile of the grip includes one or more waves.

15. The grip of claim 14, wherein the one or more waves of the grip includes a plurality of waves and wherein a first wave of the plurality of waves has a first height and a second wave of the plurality of waves has a second height that is different from the first height.

16. The grip of claim 11, wherein an outer profile of the grip includes a spine extending along a majority of a length of the grip, the outer profile of the spine complementing a shape of an inner profile of a slot of a jaw, and wherein the slot is configured to receive the spine thereby retaining the grip within the jaw.

17. The grip of claim 16, further comprising a stop on the grip wherein the stop is configured to prevent movement of the spine within the slot when the spine is received within the jaw.

18. A method of using a hair gripping device comprising:

placing a plurality of hair strands onto a grip surface of a jaw of the hair gripping device of claim 1;

imparting a holding strength on the plurality of hair strands by actuating the jaw, providing uniform translation of opposing portions of the jaw between an open position and a closed position such that the first and second grip surfaces remain parallel to each other, and in a closed position movement of the plurality of hair strands proximal to the grip surface is minimized to thereby mitigate uprooting during styling; and styling the plurality of hair strands distal to the device.

19. The method of using the hair gripping device of claim 18, wherein placing the plurality of hair strands onto the grip surface of the hair gripping device comprises spreading the plurality of hair strands over a length of the grip surface so as to maximize an amount of hairs that are in contact with the grip surface.

20. The method of using the hair gripping device of claim 18, further comprising repeating the method over a plurality of har sections comprising a plurality of hair strands.

* * * * *